US010580048B2

(12) United States Patent
West et al.

(10) Patent No.: US 10,580,048 B2
(45) Date of Patent: Mar. 3, 2020

(54) SYNCHRONIZING A COST ESTIMATE ON AN ELECTRONIC DEVICE

(75) Inventors: William B. West, Sandy, UT (US); Wallace Eric Smith, Pleasant Grove, UT (US); Paul E. Nagel, Draper, UT (US)

(73) Assignee: WirePath Home Systems, LLC, Salt Lake City, UT (US)

( * ) Notice: Subject to any disclaimer, the term of this patent is extended or adjusted under 35 U.S.C. 154(b) by 1020 days.

(21) Appl. No.: 12/961,742

(22) Filed: Dec. 7, 2010

(65) Prior Publication Data

US 2011/0137826 A1 Jun. 9, 2011

Related U.S. Application Data

(60) Provisional application No. 61/267,308, filed on Dec. 7, 2009.

(51) Int. Cl.
*G06Q 30/04* (2012.01)

(52) U.S. Cl.
CPC ..... *G06Q 30/04* (2013.01)

(58) Field of Classification Search
CPC ..... G06Q 30/04
USPC ..... 705/7.35
See application file for complete search history.

(56) References Cited

U.S. PATENT DOCUMENTS 6,934,740 B1 * 8/2005 Lawande ..... G06F 17/30908 707/999.104
8,095,233 B1 * 1/2012 Shankar ..... H02J 3/14 700/148
2002/0075844 A1 * 6/2002 Hagen ..... H04L 63/0442 370/351
2006/0103549 A1 * 5/2006 Hunt ..... G01D 4/004 340/870.02
2008/0052253 A1 * 2/2008 Edwards et al. ..... 705/412
2008/0126516 A1 * 5/2008 Holt ..... G06F 9/52 709/218
2009/0083167 A1 * 3/2009 Subbloie ..... 705/34
2009/0309756 A1 * 12/2009 Mason, Jr. ..... G01D 4/004 340/870.02
2011/0066297 A1 * 3/2011 Saberi ..... F16K 31/046 700/287

OTHER PUBLICATIONS

Woodcock, Connie, "Hydro lights us up; Smart meters will increase bills dramatically for many Ontarians," The Toronto Sun, 20, Toronto: Postmedia Network Inc., Jul. 15, 2009.*

* cited by examiner

*Primary Examiner* — Nathan Erb
(74) *Attorney, Agent, or Firm* — Austin Rapp

(57) ABSTRACT

A method for synchronizing a cost estimate on an electronic device is described. The method includes obtaining an estimated usage by an electronic device. The method also includes obtaining an estimated rate. The method further includes estimating, on the electronic device, a bill for a period-to-date to produce an estimated bill. The method also includes determining, on the electronic device, whether to synchronize. The method further includes synchronizing, on the electronic device, the estimated bill using actual bill information for the period-to-date if it is determined to synchronize.

11 Claims, 10 Drawing Sheets

SYNCHRONIZING A COST ESTIMATE ON AN ELECTRONIC DEVICE

RELATED APPLICATIONS

This application is related to and claims priority from U.S. Provisional Patent Application Ser. No. 61/267,308, filed Dec. 7, 2009, for "SYNCHRONIZING COST ESTIMATES," which is incorporated herein by reference.

TECHNICAL FIELD

The present invention relates generally to electronic devices. More specifically, the present invention relates to systems and methods for synchronizing a cost estimate on an electronic device.

BACKGROUND

In recent years, the price of electronic devices has decreased dramatically. In addition, the types of electronic components that can be purchased have continued to increase. For example, DVD players, large screen TVs, multi-carousel CD and DVD players, MP3 players, video game consoles, and similar consumer electronic items have become more widely available while continuing to drop in price.

The decreasing prices and increasing types of electronic components have packed today's homes and businesses with modern conveniences. Typical homes and businesses now include more power-consuming devices than ever before. As more of these components are sold, the average household power consumption also increases. As power demands increase, the cost of running these devices also increases. The ever-increasing cost of resources, such as electricity, may be a concern. Utility (e.g., resource) providers may even introduce variable pricing, charging more for resources during peak consumption.

As utility or resource costs increase, home owners and businesses may seek to monitor their resource consumption and cost. However, it may be difficult to accurately estimate the cost-to-date for resource consumption in a given time period. Accordingly, systems and methods that improve cost estimate accuracy may be beneficial.

DETAILED DESCRIPTION

Figure 1:
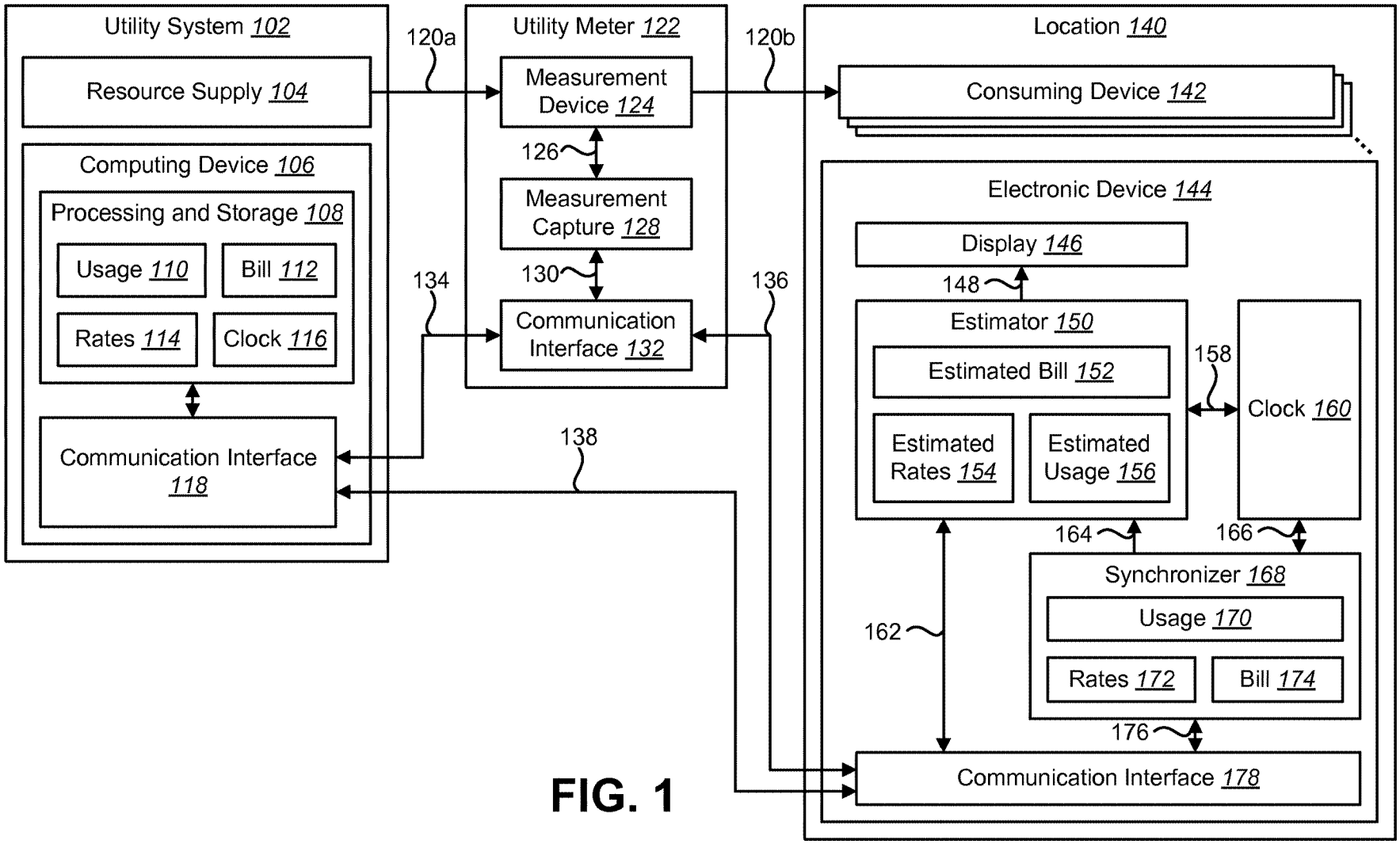
FIG. 1 is a block diagram illustrating one configuration of an electronic device in which systems and methods for synchronizing a cost estimate may be implemented.

The terms "power" and "energy" may be used interchangeably herein. It is to be understood that "power" generally refers to a rate at which work is performed (e.g., measured in watts or comparable units), while "energy" generally refers to a capacity for doing work (e.g., measured in kilowatt-hours (kWh), joules or comparable units). However, the term "power" may be used herein to refer to both. For example, the term "power" as used herein may refer to a rate of transfer, use, or generation of electrical energy as well as electrical energy itself. It should also be noted that as used herein, the term "bill" may be used to refer to the more general term "cost." Furthermore, the term "bill" may refer to a bill balance (where a billing cycle for the bill is not yet completed, for example).

A method for synchronizing a cost estimate on an electronic device is disclosed. The method includes obtaining an estimated usage by an electronic device. The method also includes obtaining an estimated rate. Furthermore, the method includes estimating, on the electronic device, a bill for a period-to-date to produce an estimated bill. Additionally, the method includes determining, on the electronic device, whether to synchronize. The method further includes synchronizing, on the electronic device, the estimated bill using actual bill information for the period-to-date if it is determined to synchronize. Determining whether to synchronize may be performed without user interaction. Determining whether to synchronize may be performed based on user interaction. The estimated usage may be obtained from a utility meter. The electronic device may be an In-Home Display.

The actual bill information may include an actual bill. The actual bill information may include an actual usage. The actual bill information may include an actual rate.

Synchronizing the estimated bill using actual bill information for the period-to-date may include sending authentication information to a utility system and requesting the actual bill information from the utility system. Synchronizing may also include receiving the actual bill information from the utility system and using the actual bill information to synchronize the estimated bill. Synchronizing the estimated bill using actual bill information may include adjusting the estimated bill to match the actual bill for a period-to-date.

Synchronizing the estimated bill using the actual bill information for a period-to-date may be performed according to the equation $$C_n = B_k + \sum_{i=k}^{n} U_i R_i \begin{cases} B_0 = 0 \\ U_{0,i=k} = 0 \\ k = 0 \text{ before synchronization} \\ k = n \text{ at synchronization} \end{cases}.$$

$C_n$ may be the estimated bill for a period-to-date for a current sample number n. $B_k$ may be an actual bill and k may be a sample number when a most recent synchronization occurs.

i may be an index number, $U_i$ may be the estimated usage for a sample corresponding to index i and $R_i$ may be the estimated rate for a sample corresponding to index i.

An electronic device for synchronizing a cost estimate is also disclosed. The electronic device includes a processor and instructions stored in memory. The electronic device obtains an estimated usage. The electronic device also obtains an estimated rate. Furthermore, the electronic device estimates a bill for a period-to-date to produce an estimated bill. The electronic device determines whether to synchronize. The electronic device further synchronizes the estimated bill using actual bill information for the period-to-date if it is determined to synchronize.

A computer-readable medium configured to synchronize a cost estimate is also disclosed. The computer-readable medium includes executable instructions for obtaining an estimated usage and obtaining an estimated rate. The computer-readable medium also includes instructions for estimating a bill for a period-to-date to produce an estimated bill. Furthermore, the computer-readable medium includes instructions for determining whether to synchronize and for synchronizing the estimated bill using actual bill information for the period-to-date if it is determined to synchronize.

Resource consumers may desire to obtain an estimate of a cost-to-date or bill-to-date of resource consumption. Consumers may thus use systems in an effort to estimate and track the cost of their resource consumption. Some systems may estimate this cost based on the resource usage of consuming devices. However, because of measurement imprecision (e.g., time synchronization imprecision, network latency, etc.), inaccuracies may be introduced into the cost estimate. Consumers may desire a more accurate cost estimate. Thus, systems and methods for synchronizing a cost estimate on an electronic device may improve the accuracy of the cost estimate.

In one configuration, for example, a utility system may charge varying rates based on a time of day. For instance, a higher rate may be charged during certain times. In one configuration, both a utility system and a consuming entity (e.g., home, business, building, location, etc.) may obtain resource usage measurements from a utility meter at the approximate time of a rate change. However, because of network latencies and/or a lack of synchronization between the consuming entity's clock and the utility system's clock, different rates may be applied to different utility meter readings, thus leading to inaccuracies in the entity's bill-to-date estimate.

According to the systems and methods disclosed herein, the entity may synchronize its bill-to-date estimate with the utility system's actual bill-to-date. For example, the actual bill-to-date may be obtained from the utility system, thus reducing inaccuracies in the bill-to-date estimate (up to the time of the actual bill-to-date, for example).

Various configurations of the invention are now described with reference to the Figures, where like reference numbers may indicate identical or functionally similar elements. The configurations of the present invention, as generally described and illustrated in the Figures herein, could be arranged and designed in a wide variety of different configurations. Thus, the following more detailed description of several configurations of the present invention, as represented in the Figures, is not intended to limit the scope of the invention, as claimed, but is merely representative of configurations of the invention.

FIG. 1 is a block diagram illustrating one configuration of an electronic device 144 in which systems and methods for synchronizing a cost estimate may be implemented. FIG. 1 also illustrates a utility system 102, a utility meter 122 and a location 140. The utility system 102 may be an entity that provides a resource and/or charges or bills for resource usage. Examples of a utility system 102 include an electric company, natural gas company, water company, etc. Although a single utility system 102 is illustrated in FIG. 1, one or more utility systems 102 may be used at a time according to the systems and methods disclosed herein.

The utility system 102 may include a resource supply 104 and a computing device 106. The resource supply 104 may an entity that provides a particular resource. Some examples of a resource supply 104 include a power plant, electrical generators, a water supply (e.g., water tanks, water treatment, etc.), a fuel supply (e.g., gas tanks), etc. The resource supply 104 may provide a particular resource or utility, such as electricity, water, natural gas, oil, etc. The resource supply 104 may be coupled to a utility meter 122. For example, the resource supply 104 may provide, transmit or distribute the resource 120. The resource 120*a* may be conveyed to the utility meter 122. The resource 120*b* may then be provided to the location 140. In other words, the resource 120 may be conveyed over some structure for transmission, distribution or conveyance. For example, electricity may be provided through a power grid or network of power lines and substations. Water may be provided through pipes, tanks and reservoirs, etc. Natural gas may be provided through gas lines (e.g., pipes), compression stations and governors, etc. Other structures or variations may be used, depending on the type of resource.

The computing device 106 may be a device that is used to track resource usage or consumption. The computing device 106 may also be used to bill consumers of the resource or utility. Examples of the computing device 106 include one or more desktop computers, laptop computers, servers, etc. The computing device 106 may include a processing and storage block/module 108 and a communication interface 118. The processing and storage block/module 108 may be implemented as hardware, software or a combination of both. For example, the processing and storage block/module 108 may comprise one or more processors, memory, software and/or other components. In one configuration, the processing and storage block/module 108 includes rates 114, usage 110, bill 112 and a clock 116.

A rate 114 is the amount of money charged for a particular amount of a resource consumed. For example, an electric or power company might charge a certain dollar amount per kilowatt-hour (kWh), while a water company could charge per gallon, and a natural gas company might charge per hundred cubic feet (ccf). Rates 114 may vary. For example, the utility system 102 may vary its rates 114 based on overall demand for the resource. For instance, the utility system 102 may increase its rates 114 during high-demand periods (for its resource). As discussed above, the rates 114 may vary according to a time model, a demand model, a hybrid of both, or others.

Usage 110 is the utility system's 102 measurement of resource usage of an entity. An entity, such as a location 140 (e.g., building, residence, business, etc.) may consume or use a resource. The utility system 102 may measure that usage 110. For example, an electric company records the electricity usage 110 of a location 140. The utility system 102 may apply its rates 114 to the usage 110 of a particular location 140 in order to generate a bill 112. A bill 112 may represent the cost for the resource usage 110 at the location 140. For example, a bill 112 may be the amount of money owed to the utility system 102 for the resource usage 110. The usage 110, rates 114 and/or bill 112 as used and/or generated by the utility system 102 may be referred to as actual usage 110, actual rates 114 and an actual bill 112, since the utility system 102 determines the actual cost or bill for resource usage.

In some configurations, the processing and storage block/module 108 may include a clock 116. The clock 116 may be used to time stamp a usage 110 measurement, determine the beginning and/or end of a billing cycle, determine the time of a rate 114 change, etc. Thus, in some configurations, the bill 112 may be based on the timing provided by the clock 116. For example, the time of a rate 114 change and the time that a usage 110 measurement is taken may be based on the clock 116.

The communication interface 118 may be a block/module used to communicate with other devices. The communication interface 118 may be implemented in hardware, software or a combination of both. Examples of a communication interface 118 include a Local Area Network (LAN) card, Universal Serial Bus (USB) card, wireless card and/or modem, etc. The communication interface 118 included in the utility system 102 may communicate with other devices. For example, the communication interface 118 may send information 134 to and/or receive information 134 from the utility meter 122. Additionally or alternatively, the communication interface 118 may send information 138 to and/or receive information 138 from the location 140.

The communication interface 118 may communicate with the location 140. For example, in one configuration, the utility system 102 communicates information 134, 136 with the location 140 through the utility meter 122. In another configuration, the utility system 102 communicates information 138 with the location 140 independent of the utility meter 122. In yet another configuration, the utility system 102 may communicate one or more kinds of information 134, 136, 138 with the location 140 both through the utility meter 122 and/or independent of the utility meter 122. It should be noted that information 134 communicated between the utility system 102 and utility meter 122, information 136 communicated between the utility meter 122 and the location 140 and/or information 138 communicated between the utility system 102 and the location 140 (independent of the utility meter 122) may be the same or different.

The utility meter 122 may be a device that measures and provides measurements (e.g., data) of resource consumption or usage 110. Examples of the utility meter 122 include electricity meters, water meters and gas meters, etc. The utility meter 122 may include a measurement device 124, a measurement capture block/module 128 and/or a communication interface 132. The measurement device 124 may be a device that measures resource usage 110 or consumption. Some examples of measurement devices 124 include ammeters/voltmeters (for measuring electrical energy consumption), water metering devices (e.g., displacement meters, velocity meters, etc.) and gas metering devices (e.g., diaphragm meters, rotary meters, turbine meters, etc.). Although a single utility meter 122 is illustrated in FIG. 1, one or more utility meters 122 may be used at a time according to the systems and methods disclosed herein.

The measurement device 124 provides usage measurements 126 to the measurement capture block/module 128. For example, the measurement capture block/module 128 may request and/or receive usage measurements 126 from the measurement device 124. The measurement capture block/module 128 may be implemented in hardware and/or software. In some configurations, the measurement capture block/module 128 may include a processor, memory, software and/or firmware. The measurement capture block/module 128 captures (e.g., receives, stores, etc.) the usage measurements 126 provided by the measurement device 124. In some configurations, the measurement capture block/module 128 includes a clock (not shown in FIG. 1). The clock may be used to time stamp the measurements taken from the measurement device 124, to schedule/determine when to take measurements and/or to schedule/determine when to report measurements, for example. In one configuration, the utility meter 122 may store one or more measurements and/or corresponding interval (e.g., time stamp) data. For example, multiple measurements and/or corresponding interval information may be stored in a table. In this way, the utility meter 122 may provide multiple measurements to the location 140 and/or to the utility system 102 at a time.

The measurement capture block/module 128 may provide measurements and/or other information 130 to the communication interface 132. The communication interface 132 may communicate information 134 with the utility system 102 and may communicate information 136 with the location 140. For example, the communication interface 132 may communicate resource usage measurements and/or other information 134 to the utility system 102 and/or may communicate resource usage measurements and/or other information 136 to the location 140. Additionally or alternatively, the communication interface 132 may relay information 134, 136 between the utility system 102 and the location 140. Requests for resource usage measurements may additionally or alternatively be received by the communication interface 132 (from the utility system 102 and/or the location 140). Such a request may be provided to the measurement capture block/module 128, which may provide a usage measurement 130 to the communication interface 132 for transmission to the utility system 102 and/or to the location 140. Although a single location 140 is illustrated in FIG. 1, one or more locations 140 may be used at a time according to the systems and methods disclosed herein.

The utility system 102 may measure resource usage 110 by communicating with or "reading" the utility meter 122. The utility system 102 may communicate with the utility meter 122, such that it may take usage 110 measurements (e.g., remotely take measurements). That is, the utility meter 122 may measure and/or record the resource usage 110 of a location 140. In one configuration, the utility meter 122 is a "smart" electricity meter that measures usage 110 and transmits the usage 110 measurement to the utility system 102. The utility system 102 and/or location 140 may request the usage 110 measurement or the utility meter 122 may transmit it (to the utility system 102 and/or location 140) without a request. These usage measurements may be communicated to the utility system 102 on a fixed schedule or alternatively, when certain conditions are met (e.g., a usage measurement is requested, a certain amount of usage has occurred, when bandwidth is available to make the communication, etc.). In one configuration, the utility system 102 may transmit the rates 114 to the utility meter 122, such that the rates 114 are stored on the utility meter 122. Additionally or alternatively, the utility system 102 may notify the utility meter 122 that a rate 114 change has occurred.

The location 140 may be a place, such as a building, a facility, a home, an apartment, or any place where a resource is consumed (and possibly measured, for example). This location 140 may include one or more consuming devices 142. The consuming devices 142 may include any device that consumes a resource (e.g., electricity, water, gas, etc.). Some examples of electricity-consuming devices 142 include refrigerators, dishwashers, televisions, computers, furnaces, water heaters, game consoles, toasters, clothes washers, dryers, lights, furnaces, air conditioning units and so on. Examples of water-consuming devices 142 include toilets, swimming pools, dishwashers, water heaters, outdoor hose bibs, sprinkling systems, water taps, etc. Examples of natural gas-consuming devices 142 include water heaters, stoves, furnaces, etc.

The location 140 may include an electronic device 144. Although the location 140 is illustrated as including the electronic device 144, in some configurations, the electronic device 144 may be located remotely from the location 140. Examples of electronic devices 144 include computing devices, wall-mounted devices, desktop computers, laptop computers, tablet devices, thermostats, controls, etc. The electronic device 144 may monitor the resource usage (e.g., overall consumption, consumption patterns, etc.) of the location 140 (e.g., consuming devices 142). In some configurations, the electronic device 144 may control the consuming devices 142.

The electronic device 144 may include a display 146, estimator 150, clock 160, synchronizer 168 and/or communication interface 178. The display 146 may be a device used to convey visual information. Examples of displays 146 include Liquid Crystal Displays (LCDs), Light-Emitting Diode (LED) displays (e.g., Active Matrix Organic LED (AMOLED) displays), Cathode Ray Tube (CRT) displays, touchscreens, monitors, etc. The display 146 may be used to present or display an estimated bill 152. For example, a user may use the electronic device 144 to view an estimated bill 152 for a period-to-date. More specifically, the estimator 150 may send estimated bill information 148 to the display 146 that can be used to render an image of the estimated bill 152. It should be noted that the estimated bill 152 may be a bill "balance," where a billing cycle or period for the bill is not yet complete. Thus, the term "bill" may not always necessarily mean a "total bill" for a billing cycle or period. It should be noted that in some configurations, the electronic device 144 may not include a display at all, but may present information and/or be interacted with by communicating information with another electronic device.

The estimator 150 may be a block/module implemented in hardware, software or a combination of both. The estimator 150 may estimate or generate an estimated bill 152 for a period-to-date. The synchronizer 168 may be a hardware and/or software block/module used to synchronize the estimated bill 152 (for a period-to-date) with the actual bill 112 from the utility system 102. More detail regarding the estimator 150 and the synchronizer 168 are given below. The communication interface 178 on the electronic device 144 may be used to communicate with other devices. For example, the communication interface 178 on the electronic device 144 may be used to communicate with the utility meter 122 and the utility system 102 (e.g., computing device 106). The clock 160 may be used for electronic device 144 operation. For example, the clock 160 may be used to schedule or determine when to synchronize the estimated bill 152 with the actual bill 112, when to obtain a usage measurement from the utility meter 122, etc. For example, the clock 160 may provide timing information 158 to the estimator 150 and/or timing information 166 to the synchronizer 168. The clock 160 may optionally be used for time stamping usage measurements.

The electronic device 144 may obtain (e.g., receive, store, etc.) usage measurements from the utility meter 122 (as part of communicated information 136, for example). Obtaining usage measurements may include recording a clock time. In one configuration, the electronic device 144 records a clock time from the utility meter 122. The electronic device 144 may optionally synchronize the local electronic device 144 clock 160 with the utility meter 122 clock, where the utility meter 122 clock is the clock "master."

Having the electronic device 144 record the clock time from the utility meter 122 and/or synchronize the electronic device 144 clock 160 to a utility meter 122 clock is only one example of the systems and methods disclosed herein. Other procedures may be followed. For example, a clock time may be determined from the electronic device 144 clock 160 or some other source. Also, the electronic device 144 may not synchronize its clock 160 with the utility meter 122 clock or may only occasionally synchronize its clock with the utility meter 122 clock.

The estimator 150 estimates or generates an estimated bill 152 for a period-to-date. A period-to-date may be a billing period (e.g., a month) or some other period. In some configurations, the estimated bill 152 may be based on estimated rates 154 and/or estimated usage 156. The estimator 150 may communicate with the utility meter 122 and/or the utility system 102 using the communication interface 178. For example, the estimator 150 may send information 162 to and/or receive information 162 from the communication interface 178. For instance, the estimator 150 may request an estimated usage 156 measurement from the utility meter 122 or estimated rates 154 from the utility system 102 via the communication interface 178. The estimated rates 154 and estimated usage 156 may be estimates or deemed "estimated" as they may not accurately reflect the actual rates 114 and/or actual usage 110 as used by the utility system 102.

For example, the estimated usage 156 may be obtained from the utility meter 122. The estimated usage 156 may be an estimate since it may not be obtained at precisely the same time as the usage 110 obtained by the utility system 102. In one configuration, the utility system 102 rates 114 may vary based on a time of day. For example, the rate 114 may be twice as high between 8 a.m. and 5 p.m. as the rate 114 during other hours. However, the electronic device 144 clock 160 may not be precisely synchronized with the computing device clock 116. Thus, the usage 110 measured by the utility system 102 and the estimated usage 156 measured by the electronic device 144 may be actually taken at different times. This may be since 8 a.m. on the computing device 106 clock 116 is not at the same time as 8 a.m. on the electronic device 144 clock 160, for example. Other inaccuracies may be caused by a network latency (to communicate information 134) between the utility meter 122 and the utility system 102 that is different from a network latency (to communicate information 136) between the utility meter 122 and the electronic device 144.

The estimated rates 154 may be estimates for the same or other reasons. For example, the estimated rates 154 may only be considered estimates since their 154 timing or rate may be different from the rates 114 included on the computing device 106. In one configuration, a utility system 102 rate 114 may be based on current resource consumption. For example, the utility system 102 may monitor when total resource consumption (of the location 140 and other locations or consumers) crosses a threshold. For instance, the utility system 102 that provides electrical power may increase a rate 114 when a power plant (e.g., resource supply 104) is outputting more than a threshold number of watts. In some cases, the electronic device 144 may not be informed of the precise moment when this change in rate 114 occurs. In one configuration, the electronic device 144 may thus produce an estimated rate 154 based on past data. For instance, the change in rate 114 may occur at 9:17 a.m. on average. Thus, the estimator 150 may assume an estimated rate 154 when generating an estimated bill 152.

In another configuration, the estimated rates 154 may be considered estimates since the magnitude of the rate 114 may be unknown to the electronic device 144. For example, the rate 114 used for generating the bill 112 may be based on current consumption (of the location 140 and others). For instance, the rate 114 may vary based on the current resource consumption. In some configurations, the electronic device 144 may not have current resource consumption data, and may thus generate estimated rates 154 based on past data. Additionally or alternatively, the precise rate 114 may be unknown as a result of network latency or lack of synchronization between the utility system clock 116 and the electronic device clock 160. In the case where a utility meter 122 clock or time stamp is used, similar issues may occur (e.g., network latency, synchronization, etc.), leading to a lack of precise information on the usage 110 and/or rates 154 at the electronic device 144.

The estimated bill 152 may be determined by the estimator 150. More specifically, the estimator 150 attempts to estimate the bill 112 charged by the utility system 102. The estimator 150 may obtain estimated usage 156 (and/or estimated rates 154) from the utility meter 122. For example, in some configurations, the utility system 102 may provide rates 114 to the utility meter 122, which may be obtained by the electronic device 144. However, these may be estimated rates 154 at the electronic device 144 for the reasons described above. In another configuration, the estimator 150 may have preprogrammed (e.g., predetermined) estimated rates 154. For instance, the estimator 150 may access a table of estimated rates 154 stored on the electronic device. In some cases, however, the electronic device 144 may update the rates when newer rate information (e.g., schedules) is available from the utility system 102. In some configurations, the estimator 150 may obtain estimated rates (e.g., schedules) 154 from the utility system 102 (independent of the utility meter 122). For example, the electronic device 144 may obtain estimated rates by using the Internet to communicate with the utility system 102.

The estimated bill 152 may be generated (by the estimator 150) based on the estimated usage 156 obtained from the utility meter 122, the estimated rates 154, any actual bill 174 information, clock 160 times and/or other factors (e.g., usage patterns, bill patterns, etc.). For example, the estimator 150 may compute an estimated bill 152 by multiplying an estimated rate 154 with an estimated usage 156. Any actual bill data 174 that is available may also be used. For example, an actual bill 174 for any known time period (within a billing cycle or period, for example) may be used in combination with estimated rates 154 and estimated usage 156 for periods where the actual bill 174 is unknown. It should be noted that in some configurations, the electronic device 144 may take usage measurements (directly) from the consuming devices 142.

The synchronizer 168 may communicate with the utility system 102 to obtain actual usage 170, actual rates 172 and/or actual bill 174 information. The synchronizer 168 may provide the actual usage 170, rates 172 and/or bill 174 information 164 to the estimator 150. The synchronizer 168 may communicate information 176 with the communication interface 178 in order to accomplish this. For example, the synchronizer 168 may communicate with the utility system 102 independent of the utility meter 122 to obtain an actual bill 174. For instance, the electronic device 144 may communicate with the utility system 102 (via the Internet or some other network, for example) to obtain the bill. Additionally or alternatively, the synchronizer 168 may obtain the actual bill 174 indirectly through the utility meter 122. The actual bill 174 may be the total amount to be charged to the location 140 for a period-to-date. For example, throughout a month (or other billing cycle) the actual bill 112 at the utility system 102 accrues until the end of the billing cycle. The bill 112 for the month (or other billing cycle) may then be communicated to the location 140 (through mail, e-mail, an Internet website and/or through the electronic device 144, for example).

The actual bill 174 (for a period-to-date) may be obtained at a scheduled time or when requested (e.g., by the synchronizer 168 or on demand of a user). Alternatively or additionally, the actual bill 174 (for a period-to-date) may be sent when bandwidth is available for communication or when some other condition or trigger occurs (e.g., when a certain amount of resources has been consumed). In some configurations, the synchronizer 168 may follow authentication or security protocols in order to obtain the actual bill 174. In one configuration, the synchronizer 168 sends a user name and password to the utility system 102, which then allows access to the actual bill 112. In another configuration, the synchronizer 168 sends and/or receives encrypted data to or from the utility system 102 in order to obtain the actual bill 174. Once the actual bill 174 is received, the synchronizer 168 may send it to the estimator 150, which may use it to synchronize or adjust the estimated bill 152. In another configuration, only actual usage 170 and/or rates 172 updates may be provided by the utility system, in which case the synchronizer 168 may send the actual usage 170 and/or rates 172 to the estimator, which may use them to synchronize or adjust the estimated bill 152.

Figure 2:
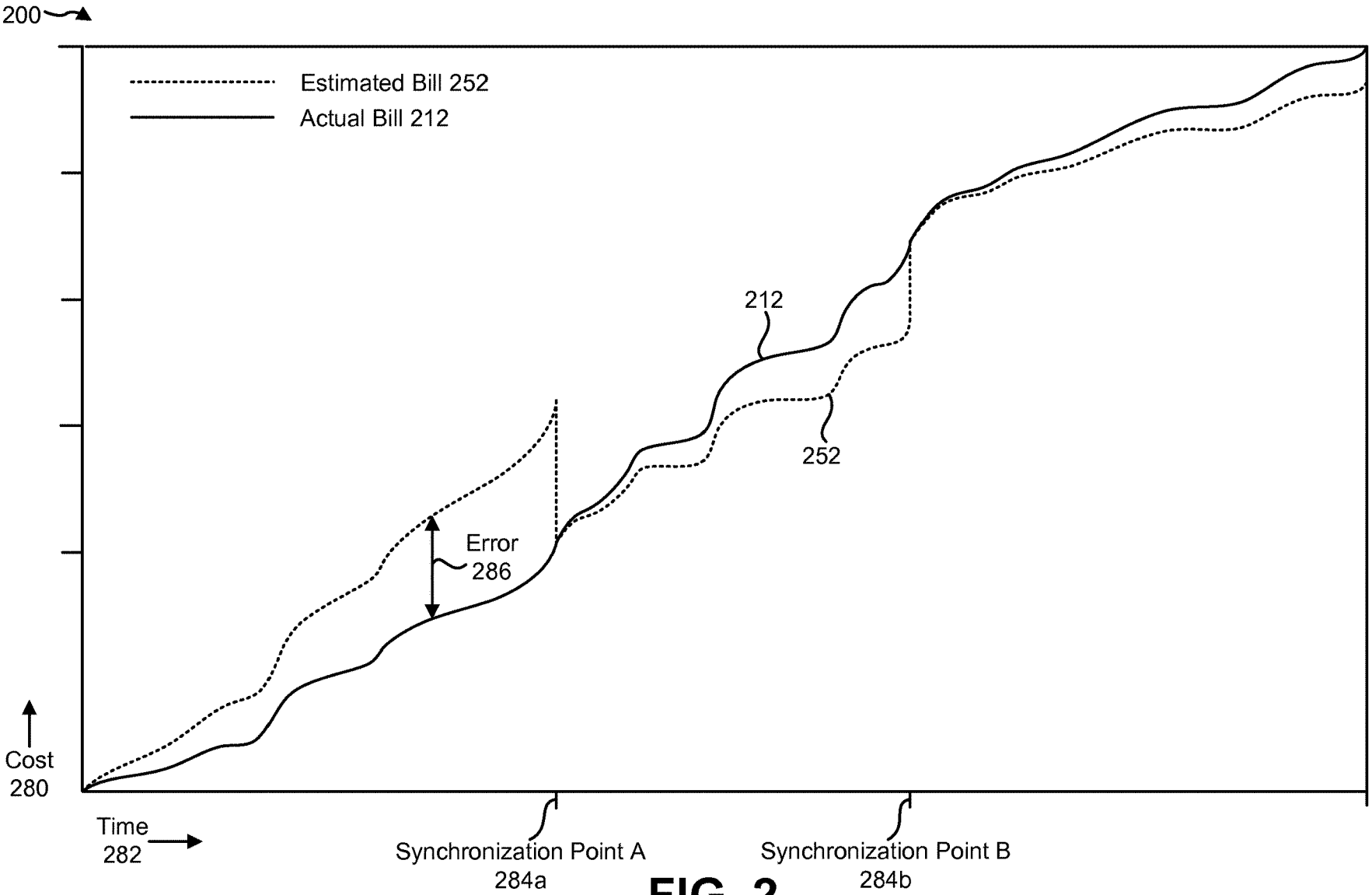
FIG. 2 is a graph illustrating the synchronization of a cost estimate.

FIG. 2 is a graph 200 illustrating the synchronization of a cost estimate. The vertical axis of the graph 200 represents cost 280. Cost 280 may be measured according to any monetary unit (e.g., dollars, yen, yuan, euros, pesos, etc.) or value. The horizontal axis of the graph 200 represents time 282. Time 282 may be measured in seconds, minutes, days, weeks, months, years or subdivisions thereof, etc. An actual bill 212 curve may represent the actual bill 212 for using a resource (as measured by a utility system 102). A resource may be, for example, electrical power, water, natural gas, etc. A utility system 102 may charge an entity the actual bill 212 for consuming resources.

The utility system 102 may charge variable rates over time 282. For example, a utility system 102 may charge a higher rate for resource consumption during high or peak consumption periods in an effort to encourage consumers to consume less of a resource during high or peak demand. Such variable pricing may include tiered or variable pricing based on time of day or amount of consumption, etc. For example, a utility system 102 may charge a flat higher rate from 8:00 am to 5:00 pm during high demand. Other pricing schemes may include changing the rate periodically based on demand.

For example, a utility system 102 may update rates on an hourly basis based on demand. A utility system 102 may also change the rate without a particular schedule (e.g., whenever consumption or demand reaches a pre-determined amount). Furthermore, a utility system 102 may change rates in a continuous fashion depending on consumption or demand. Other variable rate schemes may be used.

Because it may be unknown exactly when a utility system 102 changes rates or may be difficult to precisely synchronize clocks with the utility system 102, it may therefore be difficult to accurately estimate the actual bill 212 of resource consumption. In one possible scenario, a utility system 102 may establish a schedule for rate changes (e.g., the rate changes to x at 8:00 am and to y at 10:00 pm). Even though resource consumption may be closely monitored, the actual instant of a rate change or the precise rate itself may be unknown. For example, the utility system 102 may change the rate a few seconds after 8:00 am due to network latency or the clock at the place of measurement may not be exactly synchronized with the clock at the utility system 102. In the case where a utility system 102 may not have a set schedule for changing rates, for example, the utility system 102 may notify consumers of a rate change after an actual change in rates. Because of imprecise actions such as these, any efforts to estimate the cost for consuming a resource may include estimation errors 286 between the actual bill 212 and an estimated bill 252 for resource usage.

Over a period of time (e.g., a billing cycle), the actual bill 212 of a resource may increase or hold steady. For example, a utility system 102 may bill a consumer monthly for resource usage. If the consumer consumes the resource, the actual bill 212 over that period may increase. If the consumer does not consume the resource, the actual bill 212 may hold steady (to the end of the billing cycle, for example). Over time 282, estimation error 286 may generally grow. However, synchronization between the estimated bill 252 and the actual bill 212 may reduce the estimation error 286 over a given period. For example, as time 282 approaches synchronization point A 284*a*, the estimation error 286 may grow as differences accumulate between the actual bill 212 calculated by the utility system 102 and the estimated bill 252.

At synchronization point A 284*a*, however, the estimated bill 252 may be synchronized to the actual bill 212. The estimated bill 252 may similarly be synchronized to the actual bill 212 at synchronization point B 284*b*. The error 286 may thus be reduced or removed at the synchronization points 284*a-b*. Over the period of time 282 shown in FIG. 2, the error 286 may thus be reduced overall. For example, if a utility system 102 bills once in a four-week month, and if the typical estimation error 286 is approximately 4% over a month, synchronization on a weekly basis (e.g., the $7^{th}$, $14^{th}$, and $21^{st}$ days of the month) may cause the estimation error 286 to be reduced to approximately 1% over the month as time 282 approaches the end of the month.

Figure 3:
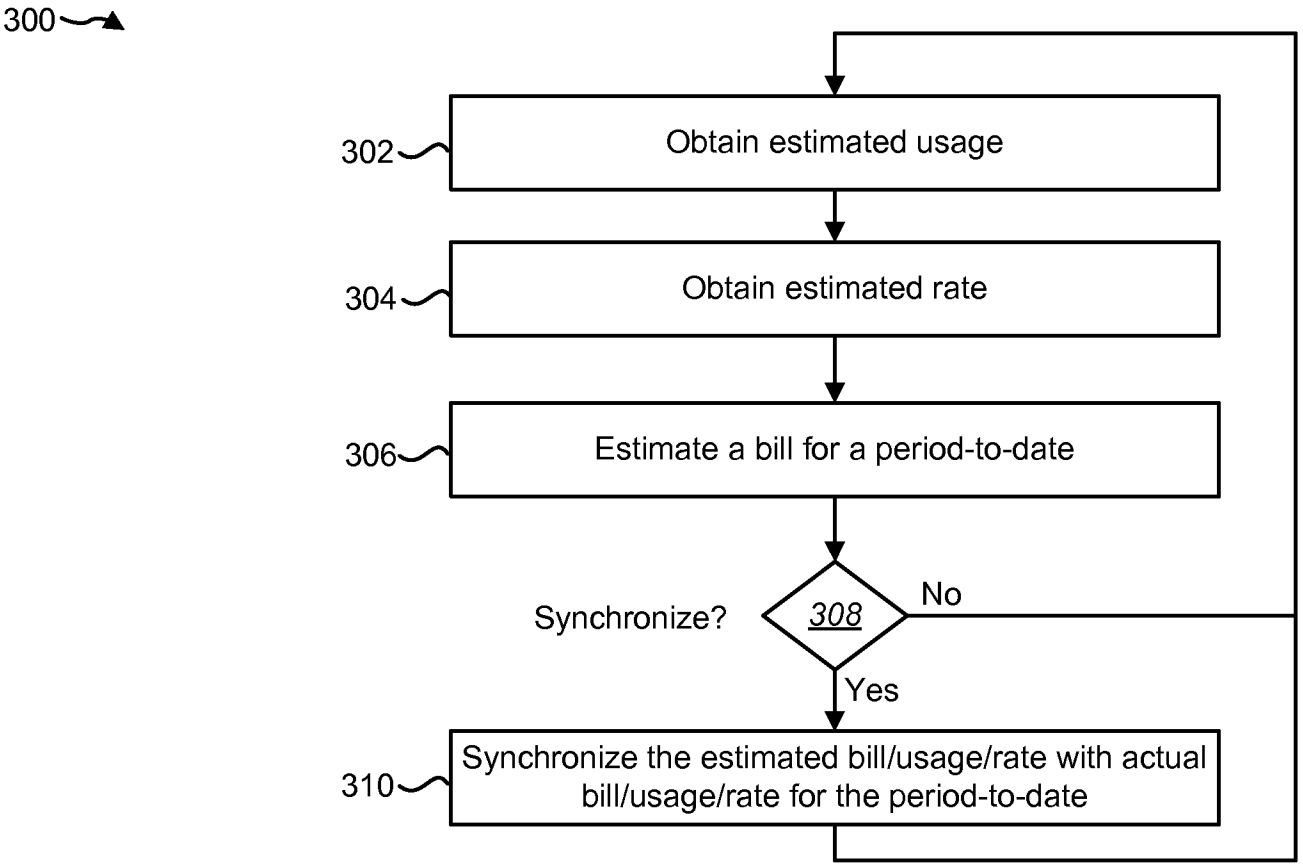
FIG. 3 is a flow diagram illustrating one configuration of a method for synchronizing cost estimates.

FIG. 3 is a flow diagram illustrating one configuration of a method 300 for synchronizing cost estimates. An electronic device 144 may obtain 302 an estimated usage 156 (of resources). The estimated usage 156 may be obtained in various ways. For example, the electronic device 144 may request and receive estimated usage 156 data from the utility meter 122. Obtaining 302 the estimated usage 156 from the utility meter 122 may include reading a data clock corresponding to the estimated usage 156 measurement. This estimated usage 156 data may be obtained 302 on a scheduled or unscheduled basis. For instance, the estimated usage 156 may be obtained 302 frequently or infrequently at scheduled or unscheduled intervals. Furthermore, the electronic device 144 may initiate an estimated usage 156 reading or may wait for the utility meter 122 to send the estimated usage 156 data. In one configuration, the estimated usage 156 may additionally or alternatively be obtained by monitoring resource usage by the consuming devices 142 directly (e.g., independent of a utility meter 122).

In one configuration, obtaining 302 an estimated usage 156 may involve obtaining multiple usage readings (e.g., estimated usage 156 measurements). For example, the utility meter 122 may store one or more measurements in a table of readings or measurements. In some configurations, the utility meter 122 may additionally store (time) interval data corresponding to the usage measurements. Thus, the electronic device 144 may obtain 302 multiple estimated usage 156 measurements and/or interval data from the utility meter 122. This may be done it one transaction or one communication session. In this way, the electronic device 144 may not communicate as often with the utility meter 122 to obtain 302 estimated usage 156 measurements.

The electronic device 144 may obtain 304 an estimated rate 154. For example, one or more estimated rates 154 and/or rate schedules may be obtained 304. In one configuration, the electronic device 144 may be preprogrammed with estimated rate 154 information (e.g., schedules) or may obtain 304 the estimated rates 154 directly from the utility system 102 or indirectly through the utility meter 122.

The electronic device 144 may estimate 306 a bill or cost for a period-to-date. In other words, the electronic device 144 may generate a bill estimate 152 for a period-to-date. In the case of a monthly bill, for example, the electronic device 144 uses estimated rates 154 and estimated usage 156 to estimate the bill-to-date. In some configurations, the electronic device 144 may additionally use data relating to rate change times to estimate 306 a bill-to-date (in the billing cycle).

The electronic device 144 may determine 308 whether to synchronize the estimated bill 152 with the actual bill 112 from the utility system 102. Additionally or alternatively, the electronic device 144 may determine 308 whether to synchronize the estimated usage 156 with the actual usage 110. Additionally or alternatively, the electronic device 144 may determine 308 whether to synchronize the estimated rate 154 with the actual rate 114. This determination 308 may be made based on one or more factors. For instance, this determination 308 may be carried out automatically (e.g., independently or autonomously without user interaction) by the electronic device 144. Additionally or alternatively, this determination 308 may be made based on user interaction (e.g., when specified by a user, upon user demand, etc.). In one configuration, the utility system 102 may only allow access to the actual bill 112 (and/or actual usage 110, actual rate 114) at specific times or only sends the actual bill 112 (and/or actual usage 110, actual rate 114) at specific times. This may come as a result of limited communications bandwidth between the utility system 102 and the electronic device 144 or possibly where the utility system 102 has established a schedule for updating bills at certain intervals. The electronic device 144 may determine 308 to synchronize the estimated bill 152 with the actual bill 112 (and/or estimated usage 156 with actual usage 110, estimated rate 154 with actual rate 114) from the utility system 102 at one or more of those allowed times.

In another configuration, the determination 308 may be based on the type of utility system 102 access available to the electronic device 144. For example, if the electronic device 144 has broadband Internet access to the utility system 102 and can access the utility system 102 at any time, then the electronic device 144 may determine 308 to synchronize more frequently. In one configuration, the electronic device 144 may include a configuration or setting that allows a user to choose how often the estimated bill 152 is synchronized with the actual bill 112 (and/or estimated usage 156 with actual usage 110, estimated rate 154 with actual rate 114). The electronic device 144 may thus determine 308 to synchronize as specified by a user.

Thus, examples of some factors that may be used in determining 308 whether to synchronize the estimated bill 152 with the actual bill 112 (and/or estimated usage 156 with actual usage 110, estimated rate 154 with actual rate 114) may include the type of access (e.g., broadband Internet, dial-up, DSL, mesh network access, telephone line access, satellite, wireless, etc.), bandwidth available, billing update schedules, type of rate variability and/or end-user demand, etc. If the electronic device 144 determines 308 to not synchronize, then operation may return to obtaining 302 an estimated usage 156, obtaining 304 estimated rates 154 and estimating or generating 306 an estimated bill 152, etc.

If the electronic device 144 determines 308 to synchronize the estimated bill 152 with the actual bill 112, 174 (and/or estimated usage 156 with actual usage 110, estimated rate 154 with actual rate 114), then the electronic device 144 may synchronize 310 its estimated bill 152 using actual bill information (e.g., an actual bill 112, actual usage 110 and/or actual rate 114) for the period-to-date from the utility system 102. For example, the electronic device 144 may receive actual bill 112 (and/or actual usage 170, actual rate 172) information from the utility system 102. The electronic device 144 may then adjust its estimated bill 152 (and/or estimated usage 156, estimated rate 154) using the information so that its estimated bill 152 matches the actual bill 112 (and/or estimated usage 156 matches actual usage 110, estimated rate 154 matches the actual rate 114) from the utility system 102 for a period-to-date. The electronic device 144 may then return to obtaining 302 estimated usage 156, obtaining 304 estimated rate(s) 154 and estimating 306 or generating an estimated bill 152.

It should be noted that the actual bill 112 may be a bill in monetary terms. In other configurations, the actual bill 174 may be generated (by the electronic device 144) based on an actual usage 170 and/or an actual rate 172. In some cases, synchronizing 310 may be performed up to a certain time. For example, the utility system 102 may provide a time stamp on the actual bill 112, usage 110, and/or rate 114. Thus, the electronic device 144 may only synchronize 310 up to that time stamp.

Figure 4:
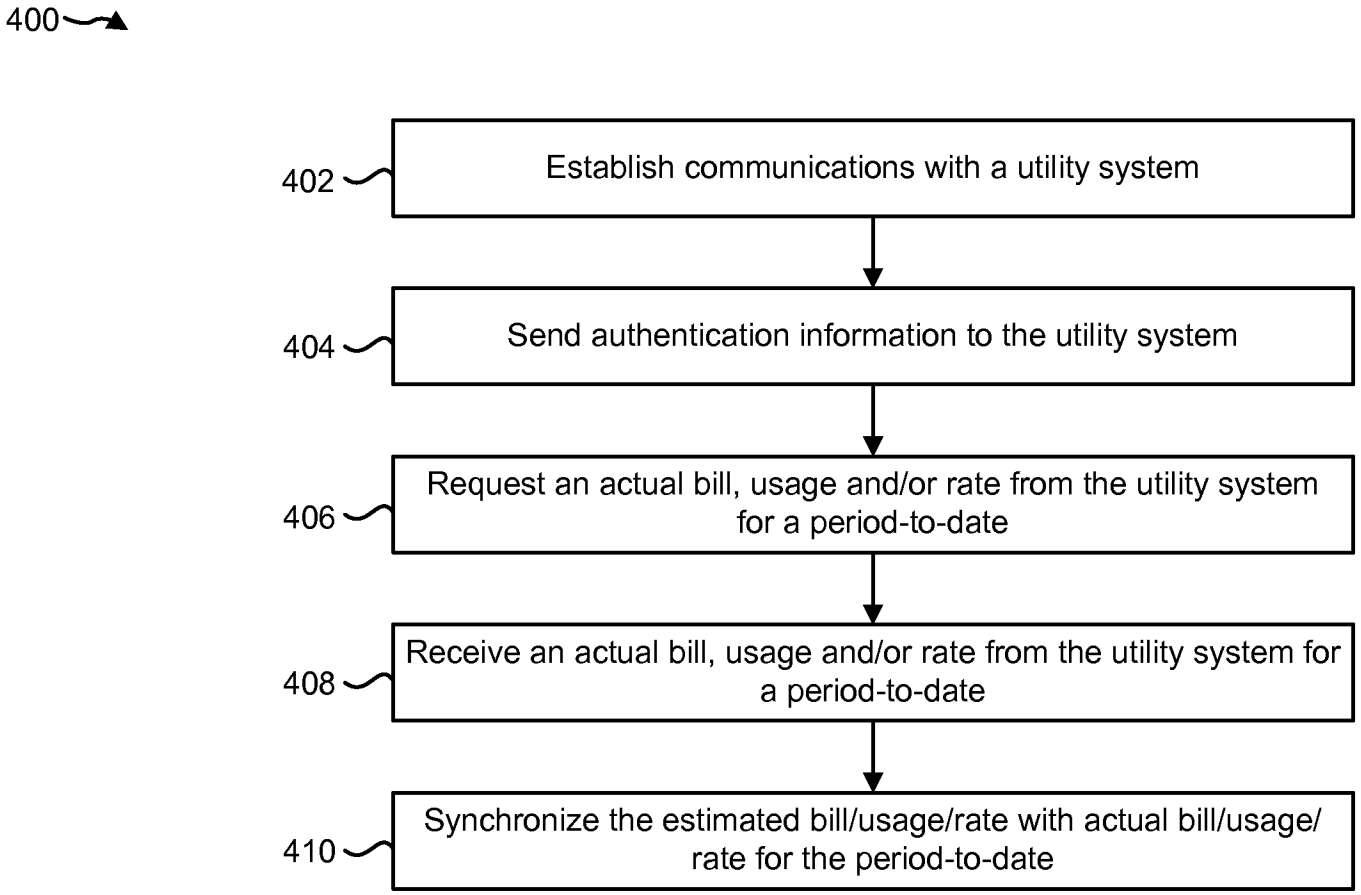
FIG. 4 is a flow diagram illustrating a more specific configuration of a method for synchronizing a cost estimate.

FIG. 4 is a flow diagram illustrating a more specific configuration of a method 400 for synchronizing a cost estimate. The electronic device 144 may establish 402 communications with the utility system 102. In one configuration, the electronic device 144 sends a signal or message to the utility system 102 requesting a connection which the utility system 102. The utility system 102 may grant this request, thereby establishing 402 communications. In another configuration, the electronic device 144 simply awaits a signal or message from the utility system 102. When the signal or message is received, the electronic device 144 may allow communication, thus establishing 402 communications.

In some configurations, the electronic device 144 may send 404 authentication information to the utility system 102. For example, the electronic device 144 may send 404 a username and/or password to the utility system 102. Other examples of authentication information include an email address, a physical address, a Media Access Control (MAC) address, a passkey, an account number, a credit card number, a social security number (SSN) of the account holder, or some other authentication information.

In some configurations, the electronic device 144 may request 406 actual bill information (e.g., the actual bill 112, actual usage 110 and/or actual rate 114) from the utility system 102. That is, the actual bill 112, actual usage 110 and/or actual rate 114 may be referred to as actual bill information. For example, the electronic device 144 sends a signal or message to the utility system 102 requesting an actual bill 112 for a period-to-date. Additionally or alternatively, the electronic device 144 may request 406 actual rate 114 and/or actual usage 110 information (e.g., how much actual usage 110 was measured at what rate 114 by the utility system 102). Such a request 406 may be sent to the utility system 102 directly or via a utility meter 122.

The electronic device 144 may receive 408 actual bill information from the utility system 102 for a period-to-date. For example, the electronic device 144 may receive the actual bill 112, actual rate 114 and/or actual usage 110. In some configurations, the actual bill 112 is received as a result of requesting 406 it. In other configurations, the actual bill 112 balance is received without requesting 406 it. The electronic device 144 may receive 408 the actual bill 112 via the utility meter 122 or directly from the utility system 102. Additionally or alternatively, the electronic device 144 may receive 408 an actual usage 110 and/or an actual rate 114.

The electronic device 144 may synchronize 410 the estimated bill 152, estimated usage 156 and/or estimated rates 154 with the actual bill 112, 174, usage 110 and/or rates 114. That is, the electronic device 144 may use actual bill information to synchronize 410. In one configuration, the estimated bill 152 is adjusted to match the actual bill 112 for a period-to-date (or some designated period). The electronic device 144 may optionally record other information (e.g., the amount of error 286 between the estimated bill 152 and the actual bill 112, the amount of error between any estimated rate 154 change times and actual rate 114 change times, etc.).

Figure 5:
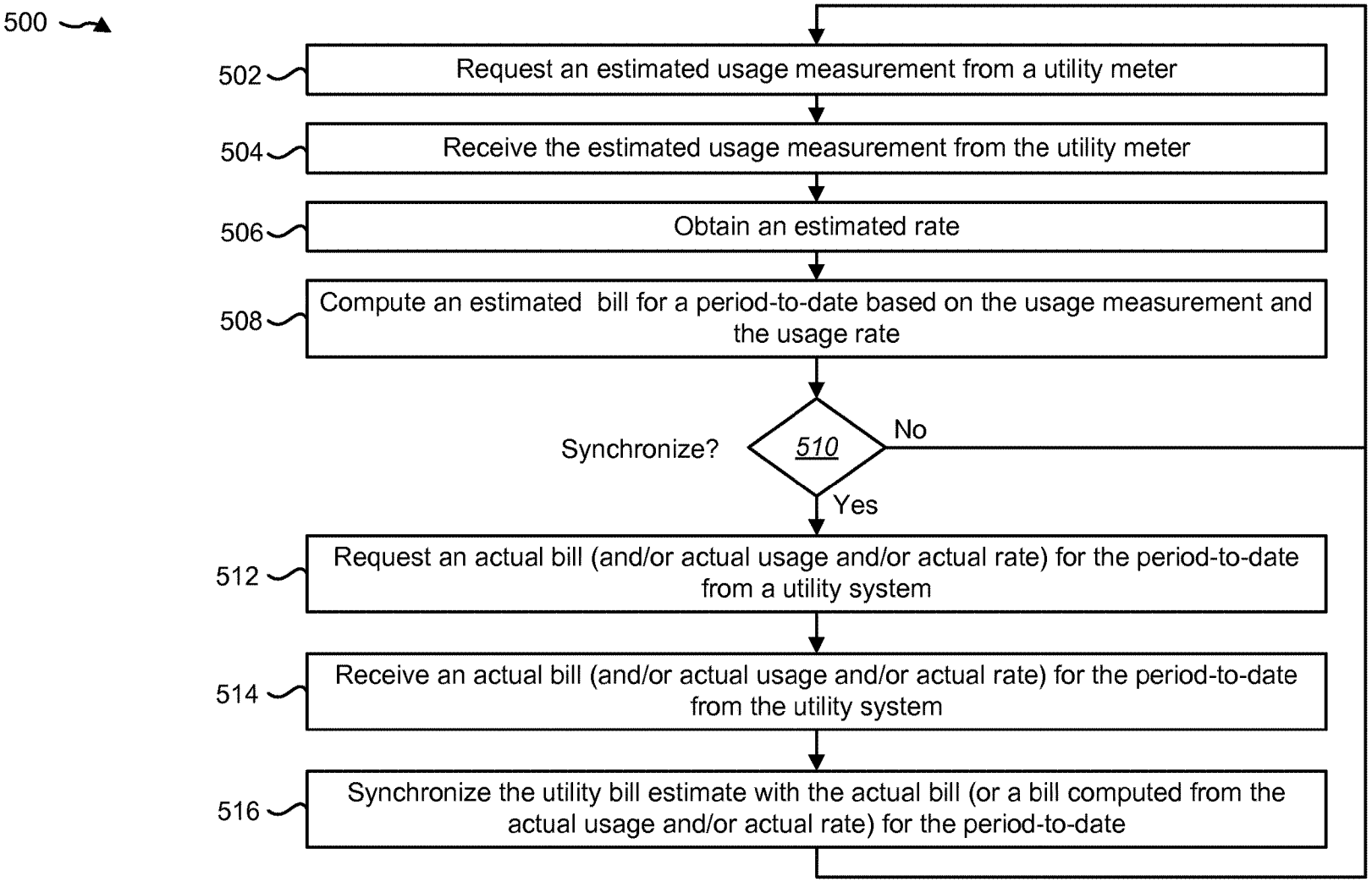
FIG. 5 is a flow diagram illustrating another more specific configuration of a method for synchronizing cost estimates.

FIG. 5 is a flow diagram illustrating another more specific configuration of a method 500 for synchronizing cost estimates. An electronic device 144 may request 502 an estimated usage 156 measurement from a utility meter 122. For example, the electronic device 144 (e.g., estimator 150) may send a signal or message to the utility meter 122 via a communication interface 178 requesting an estimated usage 156 measurement. The electronic device 144 (e.g., estimator 150) may receive 504 the estimated usage 156 measurement from the utility meter 122. The electronic device 144 (e.g., estimator 150) may receive 504 the estimated usage 156 via the communication interface 178. The estimated usage 156 may be a signal or message indicating an amount of resource usage for a period-to-date (e.g., billing period). Requesting 502 and/or receiving 504 the estimated usage 156 measurement may include reading a clock (e.g., clock 160 on the electronic device 144 and/or a utility meter 122 clock). corresponding to the estimated usage 156 measurement. This estimated usage 156 data may be requested 502 and/or received 504 on a scheduled or unscheduled basis. For instance, the estimated usage 156 may be requested 502 and/or received 504 frequently or infrequently at scheduled or unscheduled intervals. Furthermore, the electronic device 144 may optionally request 502 an estimated usage 156 measurement and/or may wait to receive 504 the estimated usage 156 measurement from the utility meter 122. In one configuration, the estimated usage 156 may also be obtained by monitoring the use of resource by the consuming devices 142 directly.

The electronic device 144 may obtain 506 an estimated rate 154. For example, one or more estimated rates 154 and/or rate schedules may be obtained 506. In one configuration, the electronic device 144 may obtain 506 the estimated rates 154 as preprogrammed information (e.g., rates, schedules, etc.) on the electronic device 144, may obtain 506 the estimated rates 154 directly from the utility system 102 or may obtain 506 the estimated rates indirectly from the utility system 102 through the utility meter 122.

The electronic device 144 may compute 508 an estimated bill 152 or cost for a period-to-date. In the case of a monthly bill, for example, the electronic device 144 uses estimated rates 154 and estimated usage 156 to estimate the bill-to-date. In some configurations, the electronic device 144 may additionally use data relating to rate change times to estimate 306 a bill-to-date (in the billing cycle). In one configuration, the electronic device 144 may compute 508 the estimated bill 152 as illustrated in Equation (1).

$$C_n = B_k + \sum_{i=k}^{n} U_i R_i \begin{cases} B_0 = 0 \\ U_{0,i=k} = 0 \\ k = 0 \text{ before synchronization} \\ k = n \text{ at synchronization} \end{cases} \quad (1)$$

In Equation (1), $C_n$ is the estimated cost or bill 152 for a period-to-date (e.g., in a billing cycle) for a current sample number n (for the period), $B_k$ is an actual bill 174 that applies up to sample number k (when a most recent synchronization occurs), i is an index number, $U_i$ is an estimated usage 156 for a sample corresponding to index i and $R_i$ is an estimated rate 154 for a sample corresponding to index i. At the beginning of a period (e.g., billing cycle), n is 0 until a sample is taken. A sample may be taken, for example, when the electronic device 144 receives 504 an estimated usage 156 from the utility meter 122. Thus, at each sample time, n is incremented. As illustrated in Equation (1), the actual bill 174 $B_k$ does not factor into the computation 508 until a synchronization occurs.

The electronic device 144 may determine 510 whether to synchronize the estimated bill 152 with the actual bill 112 from the utility system 102. Additionally or alternatively, the electronic device 144 may determine 510 whether to synchronize the estimated usage 156 with the actual usage 110 and/or may determine 510 whether to synchronize the estimated rate 154 with the actual rate 114. This determination 510 may be made based on one or more factors. In one configuration, for example, the utility system 102 may only allow access to the actual bill 112 (and/or actual usage 110 and/or actual rate 114) at specific times or only sends the actual bill 112 (and/or usage 110 and/or actual rate 114) at specific times. This may come as a result of limited communications bandwidth between the utility system 102 and the electronic device 144 or possibly where the utility system 102 has established a schedule for updating bills at certain intervals. The electronic device 144 may determine 510 to synchronize the estimated bill 152 with the actual bill 112 (and/or estimated usage 156 with actual usage 110 and/or estimated rate 154 with the actual rate 114) from the utility system 102 at one or more of those allowed times.

In another configuration, the determination 510 may be based on the type of utility system 102 access available to the electronic device 144. For example, if the electronic device 144 has broadband Internet access to the utility system 102 and can access the utility system 102 at any time, then the electronic device 144 may determine 510 to synchronize more frequently. In one configuration, the electronic device 144 may include a configuration or setting that allows a user to choose how often the estimated bill 154 is synchronized with the actual bill 112 (and/or estimated usage 156 with actual usage 110 and/or estimated rate 154 with the actual rate 114). The electronic device 144 may thus determine 510 to synchronize as specified by a user.

Thus, examples of some factors that may be used in determining 510 whether to synchronize the estimated bill 154 with the actual bill 112 (and/or estimated usage 156 with actual usage 110 and/or estimated rate 154 with the actual rate 114) may include the type of access (e.g., broadband Internet, dial-up, DSL, mesh network access, telephone line access, satellite, wireless, etc.), bandwidth available, billing update schedules, type of rate variability and/or end-user demand, etc. If the electronic device 144 determines 510 to not synchronize, then operation may return to requesting 502 and/or receiving 504 an estimated usage 156, obtaining 506 estimated rates 154 and computing 508 an estimated bill 152, etc.

If the electronic device 144 determines 510 to synchronize the estimated bill 152 with the actual bill 112 (and/or estimated usage 156 with actual usage 110 and/or estimated rate 154 with the actual rate 114), then the electronic device 144 may request 512 an actual bill 112 (and/or actual usage 110 and/or actual rate 114) for the period-to-date from the utility system 102. That is, the electronic device 144 may request 512 actual bill information. The electronic device 144 may request 512 the actual bill 112 by sending a signal or message to the utility system 102 via the communication interface 178. In one configuration, this signal or message may be sent directly to the utility system 102 (e.g., via the Internet or some other connection or network) independent of the utility meter 122. In another configuration, the signal or message may be sent indirectly to the utility system 102 by way of the utility meter 122. In yet another configuration, the signal or message may be sent both through the utility meter 122 and independent of the utility meter 122.

The electronic device 144 may receive 514 an actual bill 174 (and/or actual usage 170 and/or actual rate 172) for the period-to-date from the utility system 102. That is, the electronic device 144 may receive 514 actual bill information. For example, the electronic device 144 may receive a signal or message from the utility system 102 that indicates an actual bill 174 (and/or actual usage 170 and/or actual rate 172) for the period-to-date. In one configuration, this signal or message may be received 514 directly from the utility system 102 (e.g., over the Internet or some other network or connection) independent of the utility meter 122. In another configuration, this signal or message may be received 514 indirectly from the utility system 102 by way of the utility meter 122. In yet another configuration, the signal or message may be received 514 both through the utility meter 122 and independent of the utility meter 122. It should be noted that in some configurations, the electronic device 144 may not request 512 the actual bill 174 (and/or actual usage 170 and/or actual rate 172). In other words, the utility system 102 may unilaterally send an actual bill 174 (and/or actual usage 170 and/or actual rate 172) without a request in some configurations or instances. Thus, the electronic device 144 may receive 514 the signal or message without first requesting 512 it in some cases.

The electronic device 144 may synchronize 516 its estimated bill 152 with the actual bill 112 (or an actual bill 174 computed from actual usage 170 and/or actual rate 172) for the period-to-date. That is, the estimated bill 152 may be synchronized 516 using actual bill information. In one configuration, the electronic device 144 uses the actual bill 174 to compute an (updated) estimated bill 152. This may be computed as illustrated in Equation (1) above. For example, the utility system 102 may provide its actual bill 112, which the electronic device 144 may use as an actual bill 174 $B_k$ for a period-to-date up to the current sample number (e.g., k=n when the actual bill 174 is received 514 or when synchronization occurs). Thus, when the actual bill 174 is used for the most recent sample n=k=i, the estimated usage 156 $U_i$ is 0 and the estimated bill 152 $C_n$ is equal to the actual bill 174 $B_k$. The estimated bill 152 is thus "synchronized." It should be noted that the use of the term "synchronized" may not necessarily mean that the estimated bill 152 is precisely the same as the actual bill 112 on the utility system 102 in a particular instant. However, "synchronized" may mean that the estimated bill 152 is updated to reflect the most recent actual bill 174 (and/or actual usage 170 and/or actual rate 172) provided by the utility system 102.

In another configuration, the actual bill 174 may not be explicitly received from the utility system 102. In some configurations, for example, the utility system 102 may not always (or ever, for example) provide the actual bill 112 (e.g., in monetary terms) to the electronic device 144. For example, the utility system 102 may only provide either the actual usage 170, an actual rate 172 or both. In one configuration, for instance, the utility system 102 may only provide an actual usage 170. In another configuration, the utility system 102 may only provide an actual rate 172. In another configuration, the utility system 102 may provide both the actual usage 170 and the actual rate 172. The actual usage 170, actual rate 172 and/or both 170, 172 may be the only information provided by the utility system 102 or may be provided intermittently with an actual bill 174, depending on the configuration. For example, the "actual bill" 174 $B_k$ may be determined as illustrated by Equation (2), when only an actual usage 170 is provided.

$$B_k = UA_k \times RE_k \tag{2}$$

In Equation (2), $UA_k$ is the actual usage 170 provided by the utility system 102 and $RE_k$ is an estimated rate 154 at synchronization sample k. In another example, the "actual bill" 174 $B_k$ may be determined as illustrated by Equation (3), when only an actual rate 172 is provided.

$$B_k = UE_k \times RA_k \tag{3}$$

In Equation (3), $UE_k$ is the estimated usage 156 (e.g., retrieved from the utility meter 122) and $RA_k$ is the actual rate 172 provided by the utility system 102 at synchronization sample k. In yet another example, the "actual bill" 174 $B_k$ may be determined as illustrated by Equation (4), when an actual rate and an actual usage are provided.

$$B_k = UA_k \times RA_k \tag{4}$$

In Equation (4), $UA_k$ is the actual usage 170 provided by the utility system 102 and $RA_k$ is the actual rate 172 provided by the utility system 102 at synchronization sample k.

In one configuration, the electronic device 144 may determine the "actual bill" 174 based on the information available at synchronization sample k. For example, if the utility system 102 provides the actual bill 112 (at k), it 112 may be used as the "actual bill" 174. Alternatively, if both the actual rate 114 and actual usage 110 are provided by the utility system 102 (at k), the electronic device 144 may use both to determine the "actual bill" 174. However, if only one of an actual rate 114 or actual usage 110 is provided by the utility system 102 (at k), the electronic device 144 may determine the "actual bill" 174 using an estimated usage 156 or an estimated rate 154, respectively. This "actual bill" 174 may thus be used to synchronize 516 the estimated bill 152 with the actual bill 174 (e.g., a bill computed from actual usage 170 and/or actual rate 172) for the period-to-date. This may be done as illustrated in Equation (1) above. The electronic device 144 may then return to requesting 502 and/or receiving 504 an estimated usage measurement from the utility meter 122.

Figure 6:
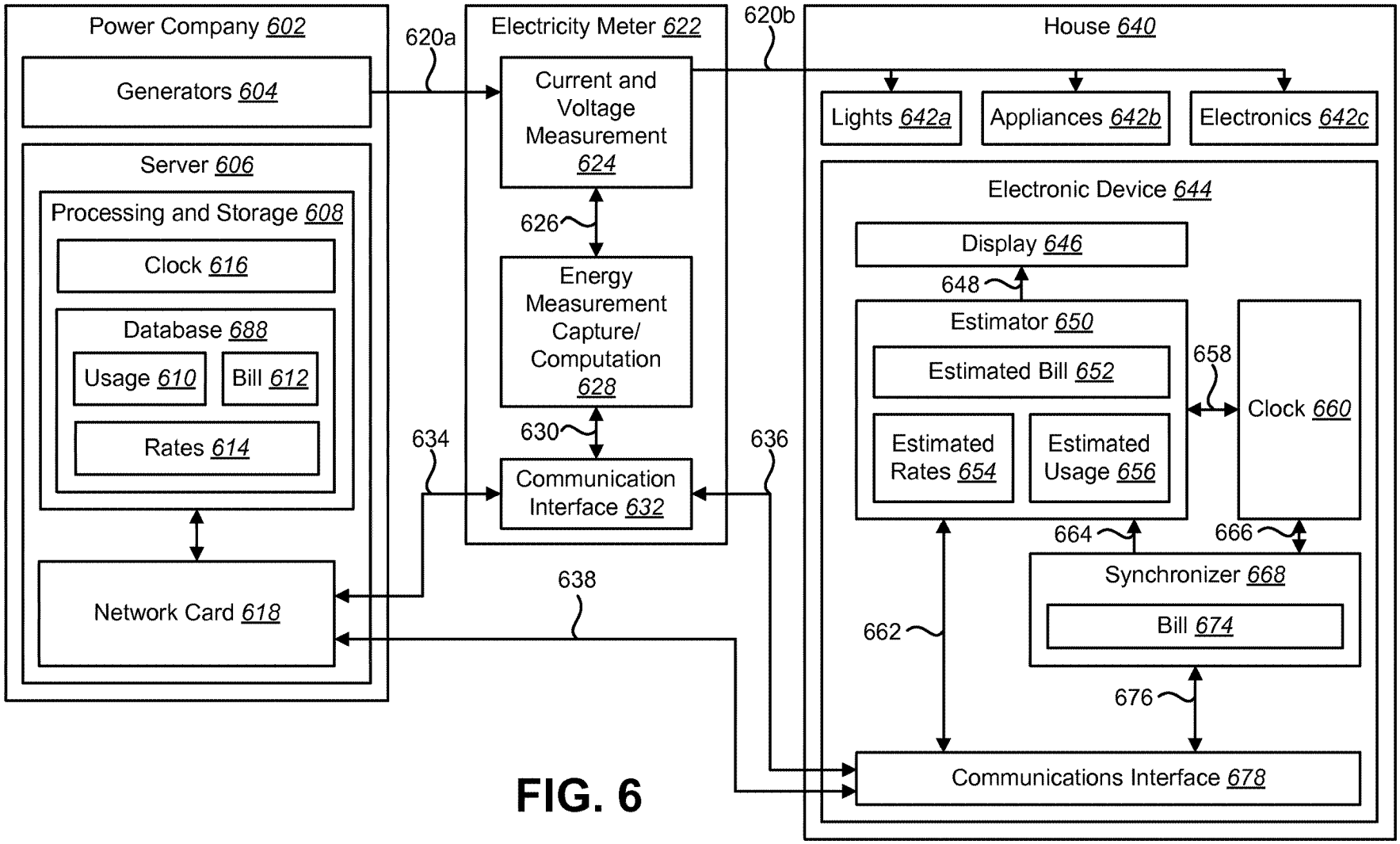
FIG. 6 is a block diagram illustrating one example of a house, electricity meter and a power company with which the systems and methods disclosed herein may be used.

FIG. 6 is a block diagram illustrating one example of a house 640, electricity meter 622 and a power company 602 with which the systems and methods disclosed herein may be used. The power company 602 may be an entity that provides electrical energy or power and/or charges or bills for usage. For example, the power company 602 may provide electricity to multiple locations (e.g., multiple houses 640, buildings, etc.). Furthermore, the power company 602 may communicate with multiple electricity meters 622.

The power company 602 may include generators 604 and a server 606. The generators 604 may generate and provide electricity, electrical power, electrical energy, etc. The generators 604 may be coupled to a electricity meter 622. For example, the generators 604 may provide, transmit or distribute electricity 620. The electricity 620*a* may be conveyed to the electricity meter 622. The electricity 620*b* may then be provided to the house 640. In other words, the electricity 620 may be conveyed over a power grid or network of power lines and substations.

The server 606 may be a computing device that is used to track usage or consumption of electricity 620 provided by the power company 602. The server 606 may also be used to bill consumers of the electricity 620. The server 606 may include a processing and storage block/module 608 and a network card 618. The processing and storage block/module 608 may be implemented as hardware, software or a combination of both. For example, the processing and storage block/module 608 may comprise one or more processors, memory, software and/or other components. In one configuration, the processing and storage block/module 608 includes a clock 616. The processing and storage block/module 608 may also include a database 688 to record and/or store one or more rates 614, bills 612 and/or usage 610 records. For example, the power company 602 may provide electricity to many houses 640 and other locations. The database 688 may be used to keep records (e.g., one or more bills 612 and/or usage 610 records) for each of the houses (and other entities) that it provides electricity to. The one or more rates 614 may be generated by the server 606 and may be recorded in the database 688 in order to generate the bill 612.

A rate 614 is the amount of money charged for a particular amount of electricity consumed. For example, the power company 602 might charge a certain dollar amount per kilowatt-hour (kWh) of electricity consumed. Rates 614 may vary. For example, the power company 602 may vary its rates 614 based on overall demand for electricity. For instance, the power company 602 may increase its rates 614 during high-demand periods (for electricity). Higher rates 614 may be charged for consumption of electricity during a hot summer day when air conditioning units are consuming a lot of electricity, for example. As discussed above, the rates 614 may vary according to a time model, a demand model, a hybrid of both, or others.

Usage 610 is the utility system's 602 measurement of the house's 640 resource usage. For example, the house 640 may consume or use electricity. The power company 602 may measure and record that usage 610. The power company 602 may apply its rates 614 to the usage 610 of the house 640 in order to generate a bill 612. A bill 612 may represent the cost for the resource usage 610 at the house 640. For example, a bill 612 may be the amount of money owed to the power company 602 for the resource usage 610.

In some configurations, the processing and storage block/module 608 may include a clock 616. The clock 616 may be used to time stamp a usage 610 measurement, determine the beginning and/or end of a billing cycle, determine the time of a rate 614 change, etc. Thus, in some configurations, the bill 612 may be based on the timing provided by the clock 616. For example, the time of a rate 614 change and the time that a usage 610 measurement is taken may be based on the clock 616.

The network card 618 may be used to communicate with other devices. Examples of a network card 618 include a Local Area Network (LAN) card, Universal Serial Bus (USB) card, wireless network card and/or modem, etc. The network card 618 included in the server 606 may communicate with other devices. For example, the network card 618 may send information 634 to and/or receive information 636 from the electricity meter 622. Additionally or alternatively, the network card 618 may send information 638 to and/or receive information 638 from the house 640 (e.g., electronic device 644).

The network card 618 may communicate with the house 640 (e.g., electronic device 644). For example, in one configuration, the power company 602 communicates information 634, 636 with the electronic device 644 through the electricity meter 622. In another configuration, the power company 602 communicates information 638 with the electronic device 644 independent of the electricity meter 622. In yet another configuration, the power company 602 may communicate one or more kinds of information 634, 636, 638 with the house 640 both through the electricity meter 622 and/or independent of the electricity meter 622. It should be noted that information 634 communicated between the server 606 and the electricity meter 622, information 636 communicated between the electricity meter 622 and the electronic device 644 and/or information 638 communicated between the server 606 and the electronic device 644 (independent of the electricity meter 622) may be the same or different.

The electricity meter 622 may be a device that measures and provides electricity 620 usage measurements. The electricity meter 622 may include a current and voltage measurement block/module 624, an energy measurement capture/computation block/module 628 and/or a communication interface 632. The current and voltage measurement block/module 624 may be a device that measures current and/or voltage. For example, the current and voltage measurement block/module 624 may include an ammeter and a voltmeter (for measuring current and voltage).

The current and voltage measurement block/module 624 provides voltage and/or current measurements 626 to the energy measurement capture/computation block/module 628. For example, the energy measurement capture/computation block/module 628 may request and/or receive usage measurements 626 from the current and voltage measurement block/module 624. The energy measurement capture/computation block/module 628 may be implemented in hardware and/or software. In some configurations, the energy measurement capture/computation block/module 628 may include a processor, memory, software and/or firmware. The energy measurement capture/computation block/module 628 captures (e.g., receives, stores, etc.) the voltage and/or current measurements 626 provided by the current and voltage measurement block/module 624. In some configurations, the energy measurement capture/computation block/module 628 includes a clock (not shown in FIG. 6). The clock may be used to time stamp the measurements taken from the current and voltage measurement block/module 624, to schedule/determine when to take measurements and/or to schedule/determine when to report measurements, for example.

The energy measurement capture/computation block/module 628 may compute energy measurements. In one configuration, for instance, the energy measurement capture/computation block/module 628 may use current and voltage measurements 626 to compute instantaneous power measurements, which it 622 may integrate over time to provide an electrical energy measurement (in kWh, for example).

The energy measurement capture/computation block/module 628 may provide measurements and/or other information 630 to the communication interface 632. The communication interface 632 may communicate information 634 with the power company 602 (e.g., server 606) and may communicate information 636 with the house 640 (e.g., electronic device 644). For example, the communication interface 632 may communicate electricity usage measurements and/or other information 634 to the power company 602 (e.g., server 606) and/or may communicate resource usage measurements and/or other information to the house 640 (e.g., electronic device 644). Additionally or alternatively, the communication interface 632 may relay information 634, 636 between the power company 602 and the house 640. Requests for resource usage measurements may additionally or alternatively be received by the communication interface 632 (from the server 606 and/or the electronic device 644, for example). Such a request may be provided to the energy measurement capture/computation block/module 628, which may provide a usage measurement 630 to the communication interface 632 for transmission to the server 606 and/or to the electronic device 644.

The power company 602 may measure resource usage 610 by communicating with or "reading" the electricity meter 622. The power company 602 may communicate with the electricity meter 622, such that it may take usage 610 measurements (e.g., remotely take measurements). That is, the electricity meter 622 may measure and/or record the resource usage 610 of a house 640. In one configuration, the electricity meter 622 is a "smart" electricity meter that measures usage 610 and transmits the usage 610 measurement to the power company 602. The server 606 and/or electronic device 644 may request the usage 610 measurement or the electricity meter 622 may transmit it (to the server 606 and/or electronic device 644) without a request. These usage measurements may be communicated to the power company 602 on a fixed schedule or alternatively, when certain conditions are met (e.g., a usage measurement is requested, a certain amount of usage has occurred, when bandwidth is available to make the communication, etc.). In one configuration, the power company 602 may transmit the rates 614 to the electricity meter 622, such that the rates 614 are stored on the electricity meter 622. Additionally or alternatively, the power company 602 may notify the electricity meter 622 that a rate 614 change has occurred.

The house 640 may be a building where electricity 620 is consumed. This house 640 may include one or more consuming devices 642. For example, the house 640 includes lights 642*a*, appliances 642*b* and electronics 642*c*. In one configuration, the electronic device 644 may be included in electronics 642*c*. The consuming devices 642 consume electricity 620 when they are used. Some examples of appliances 642*b* include refrigerators, dishwashers, furnaces, water heaters, toasters, clothes washers, dryers, furnaces, air conditioning units and so on. Examples of electronics 642*c* include televisions, computers, game consoles, etc.

The house 640 may include an electronic device 644. Examples of electronic devices 644 include computing devices, wall-mounted devices, desktop computers, laptop computers, tablet devices, thermostats, controls, etc. The electronic device 644 may monitor the resource usage (e.g., overall consumption, consumption patterns, etc.) of the house 640 (e.g., consuming devices 642). In some configurations, the electronic device 644 may control the consuming devices 642.

The electronic device 644 may include a display 646, estimator 650, clock 660, synchronizer 668 and/or communication interface 678. The display 646 may be a device used to convey visual information. Examples of displays 646 include Liquid Crystal Displays (LCDs), Light-Emitting Diode (LED) displays (e.g., Active Matrix Organic LED (AMOLED) displays), Cathode Ray Tube (CRT) displays, touchscreens, monitors, etc. The display 646 may be used to present or display an estimated bill 652. For example, a user may use the electronic device 644 to view an estimated bill 652 for a period-to-date. More specifically, the estimator 650 may send estimated bill information 648 to the display 646 that can be used to render an image of the estimated bill 652.

The estimator 650 may be a block/module implemented in hardware, software or a combination of both. The estimator 650 may estimate or generate an estimated bill 652 for a period-to-date. The synchronizer 668 may be a hardware and/or software block/module used to synchronize the estimated bill 652 (for a period-to-date) with the actual bill 612 from the power company 602. The communication interface 678 on the electronic device 644 may be used to communicate with other devices. For example, the communication interface 678 on the electronic device 644 may be used to communicate with the electricity meter 622 and the power company 602 (e.g., server 606). The clock 660 may be used for electronic device 644 operation. For example, the clock 660 may be used to schedule or determine when to synchronize the estimated bill 652 with the actual bill 612, when to obtain a usage measurement from the electricity meter 622, etc. For example, the clock 660 may provide timing information 658 to the estimator 650 and/or timing information 666 to the synchronizer 668. The clock 660 may optionally be used for time stamping usage measurements.

The electronic device 644 may obtain (e.g., receive, store, etc.) usage measurements from the electricity meter 622 (as part of communicated information 636, for example). Obtaining usage measurements may include recording a clock time. In one configuration, the electronic device 644 records a clock time from the electricity meter 622. The electronic device 644 may optionally synchronize the local electronic device 644 clock 660 with the electricity meter 622 clock, where the electricity meter 622 clock is the clock "master."

Having the electronic device 644 record the clock time from the electricity meter 622 and/or synchronize the electronic device 644 clock 660 to a electricity meter 622 clock is only one example of the systems and methods disclosed herein. Other procedures may be followed. For example, a clock time may be determined from the electronic device 644 clock 660 or some other source. Also, the electronic device 644 may not synchronize its clock 660 with the electricity meter 622 clock or may only occasionally synchronize its clock 660 with the electricity meter 622 clock.

The estimator 650 estimates or generates an estimated bill 652 for a period-to-date. A period-to-date may be a billing period (e.g., a month) or some other period. In some configurations, the estimated bill 652 may be based on estimated rates 654 and/or estimated usage 656. The estimator 650 may communicate with the electricity meter 622 and/or the server 606 using the communication interface 678. For example, the estimator 650 may send information 662 to and/or receive information 662 from the communication interface 678. For instance, the estimator 650 may request an estimated usage 656 measurement from the electricity meter 622 or an actual bill 612 from the power company 602 (e.g., server 606) via the communication interface 678. The estimated rates 654 and estimated usage 656 may be estimates or deemed "estimated" as they may not accurately reflect the actual rates 614 and/or actual usage 610 as used by the power company 602.

For example, the estimated usage 656 may be obtained from the electricity meter 622. The estimated usage 656 may be an estimate since it may not be obtained at precisely the same time as the usage 610 obtained by the power company 602 (for a particular sample, for example). In one configuration, the power company 602 rates 614 may vary based on a time of day. For example, the rate 614 may be twice as high between 8 a.m. and 5 p.m. as the rate 614 during other hours. However, the electronic device 644 clock 660 may not be precisely synchronized with the server clock 616. Thus, the usage 610 measured by the power company 602 and the estimated usage 656 measured by the electronic device 644 may be actually taken at different times. This may be since 8 a.m. on the server 606 clock 616 is not at the same time as 8 a.m. on the electronic device 644 clock 660, for example. Other inaccuracies may be caused by a network latency (to communicate information 634) between the electricity meter 622 and the power company 602 (e.g., server 606) that is different from a network latency (to communicate information 636) between the electricity meter 622 and the electronic device 644.

The estimated rates 654 may be estimates for the same or other reasons. For example, the estimated rates 654 may only be considered estimates since their 654 timing or rate may be different from the rates 614 included on the server 606. In one configuration, a power company 602 rate 614 may be based on current resource consumption. For example, the power company 602 may monitor when total resource consumption (of the house 640 and other locations or consumers) crosses a threshold. For instance, the power company 602 may increase a rate 614 when a power plant (e.g., generators 604) is outputting more than a threshold number of watts. In some cases, the electronic device 644 may not be informed of the precise moment when this change in rate 614 occurs. In one configuration, the electronic device 644 may thus produce an estimated rate 654 based on past data. For instance, the change in rate 614 may occur at 9:17 a.m. on average. Thus, the estimator 650 may assume an estimated rate 654 when generating an estimated bill 652.

In another configuration, the estimated rates 654 may be considered estimates since the magnitude of the rate 614 may be unknown to the electronic device 644. For example, the rate 614 used for generating the bill 612 may be based on current consumption (of the house 640 and others). For instance, the rate 614 may vary based on the current resource consumption. In some configurations, the electronic device 644 may not have current resource consumption data, and may thus generate estimated rates 654 based on past data. Additionally or alternatively, the precise rate 614 may be unknown as a result of network latency or lack of synchronization between the server clock 616 and the electronic device clock 660. In the case where a electricity meter 622 clock or time stamp is used, similar issues may occur (e.g., network latency, synchronization, etc.), leading to a lack of precise information on the usage 610 and/or rates 654 at the electronic device 644.

The estimated bill 652 may be determined by the estimator 650. More specifically, the estimator 650 attempts to estimate the bill 612 charged by the power company 602. The estimator 650 may obtain estimated usage 656 (and/or estimated rates 654) from the electricity meter 622. For example, in some configurations, the power company 602 may provide rates 614 to the electricity meter 622, which may be obtained by the electronic device 644. However, these may be estimated rates 654 at the electronic device 644 for the reasons described above. In another configuration, the estimator 650 may have preprogrammed estimated rates 654. However, the electronic device 644 may update the estimated rates 654 when newer rate information (e.g., schedules) is available from the power company 602. In some configurations, the estimator 650 may obtain estimated rates (e.g., schedules) 654 from the power company 602 (independent of the electricity meter 622).

The estimated bill 652 may be generated (by the estimator 650) based on the estimated usage 656 obtained from the electricity meter 622, the estimated rates 654, any actual bill 674 information, clock 660 times and/or other factors (e.g., usage patterns, bill patterns, etc.). For example, the estimator 650 may compute an estimated bill 652 by multiplying an estimated rate 654 with an estimated usage 656. Any actual bill data 674 that is available may also be used. For example, an actual bill 674 for any known time period (within a billing cycle or period, for example) may be used in combination with estimated rates 654 and estimated usage 656 for periods where the actual bill 674 is unknown.

The synchronizer 668 may communicate with the power company 602 to obtain an actual usage bill 674. The synchronizer 668 may provide the actual bill 674 information 664 to the estimator 650. The synchronizer 668 may communicate information 676 with the communication interface 678 in order to accomplish this. For example, the synchronizer 668 may communicate with the server 606 independent of the electricity meter 622 to obtain an actual bill 674. Additionally or alternatively, the synchronizer 668 may obtain the actual bill 674 indirectly through the electricity meter 622. The actual bill 674 may be the current total amount to be charged to the house 640 for a period-to-date. For example, throughout a month (or other billing cycle) the actual bill 612 at the power company 602 accrues until the end of the billing cycle. The bill 612 for the month (or other billing cycle) may then be communicated to the house 640 (through mail, e-mail, an Internet website and/or through the electronic device 644, for example).

The actual bill 674 (for a period-to-date) may be obtained at a scheduled time or when requested (e.g., by the synchronizer 668 or on demand of a user). Alternatively or additionally, the actual bill 674 (for a period-to-date) may be sent when bandwidth is available for communication or when some other condition or trigger occurs (e.g., when a certain amount of electricity has been consumed). In some configurations, the synchronizer 668 may follow authentication or security protocols in order to obtain the actual bill 674. In one configuration, the synchronizer 668 sends a user name and password to the power company 602, which then allows access to the actual bill 612. In another configuration, the synchronizer 668 sends and/or receives encrypted data to or from the power company 602 in order to obtain the actual bill 674. Once the actual bill 674 is received, the synchronizer 668 may send it to the estimator 650, which may use it to synchronize or adjust the estimated bill 652.

Figure 7:
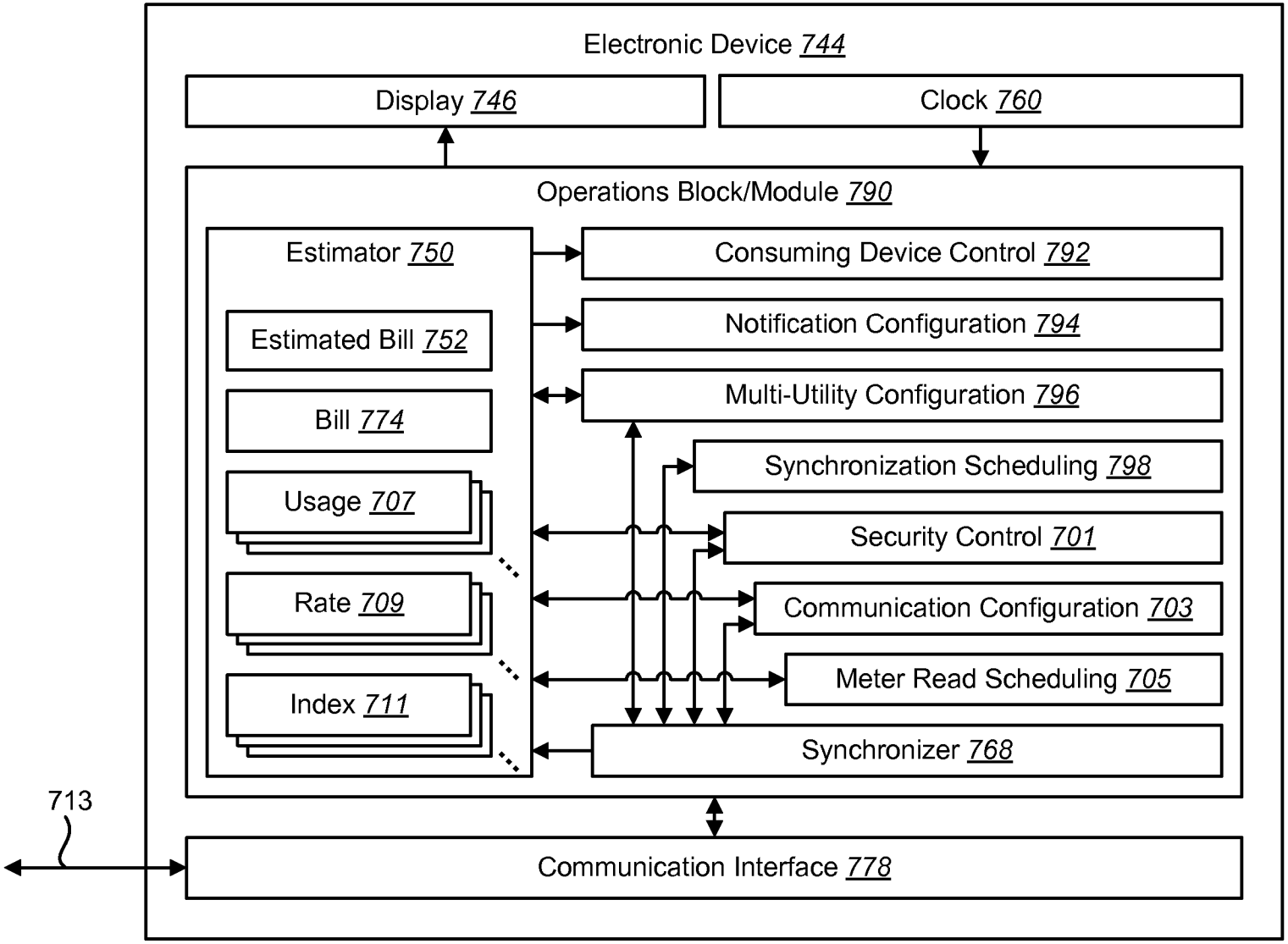
FIG. 7 is a block diagram illustrating another example of an electronic device in which systems and methods for synchronizing a cost estimate may be implemented.

FIG. 7 is a block diagram illustrating another example of an electronic device 744 in which systems and methods for synchronizing a cost estimate may be implemented. The electronic device 744 may include a display 746, clock 760, operations block/module 790 and/or communication interface 778. The display 746 may be a device used to convey visual information. Examples of displays 746 include Liquid Crystal Displays (LCDs), Light-Emitting Diode (LED) displays (e.g., Active Matrix Organic LED (AMOLED) displays), Cathode Ray Tube (CRT) displays, touchscreens, monitors, etc. The display 746 may be used to present or display an estimated bill 752. For example, a user may use the electronic device 744 to view an estimated bill 752 for a period-to-date. More specifically, the operations block/module 790 may send estimated bill 752 information to the display 746 that can be used to render an image of the estimated bill 752.

The operations block/module 790 may be a hardware block and/or software module used to perform operations on the electronic device 744. In some configurations, the operations block/module 790 may include one or more processors, memory, software, firmware and/or other components. These components may be used to implement one or more of the blocks/modules illustrated within the operations block/module 790. For example, operations block/module 790 may include an estimator 750, synchronizer 768, consuming device control block/module 792, notification configuration block/module 794, multi-utility configuration block/module 796, synchronization scheduling block/module 798, security control block/module 701, communication configuration block/module 703 and/or meter read scheduling block/module 705. Although several block/modules are illustrated within the operations block/module 790, none, one or more may be optionally implemented, depending on the configuration. The blocks/modules 750, 768, 792, 794, 796, 798, 701, 703, 705 included in the operations block/module 790 may be implemented in hardware, software or a combination of both.

The estimator 750 may be a block/module implemented in hardware, software or a combination of both. The estimator 750 may estimate or generate an estimated bill 752 for a period-to-date. The synchronizer 768 may be a hardware and/or software block/module used to synchronize the estimated bill 752 (for a period-to-date) with an actual bill from a utility system 102. The communication interface 778 on the electronic device 744 may be used to communicate with other devices. For example, the communication interface 778 on the electronic device 744 may be used to communicate information or signals 713 with one or more utility meters 122 and one or more utility systems 102. The clock 760 may be used for electronic device 744 operation. For example, the clock 760 may be used to schedule or determine when to synchronize the estimated bill 752 with the actual bill, when to obtain a usage measurement from the utility meter 122, etc. For example, the clock 760 may provide timing information to the estimator 750 and/or timing information to the synchronizer 768. The clock 760 may optionally be used for time stamping usage measurements.

The electronic device 744 may obtain (e.g., receive, store, etc.) usage measurements from the utility meter 122 (as part of received information 713, for example). Obtaining usage measurements may include recording a clock time. In one configuration, the electronic device 744 records a clock time from the utility meter 122. The electronic device 744 may optionally synchronize the local electronic device 744 clock 760 with the utility meter 122 clock, where the utility meter 122 clock is the clock "master."

Having the electronic device 744 record the clock time from the utility meter 122 and/or synchronize the electronic device 744 clock 760 to a utility meter 122 clock is only one example of the systems and methods disclosed herein. Other procedures may be followed. For example, a clock time may be determined from the electronic device 744 clock 760 or some other source. Also, the electronic device 744 may not synchronize its clock 760 with the utility meter 122 clock or may only occasionally synchronize its clock 760 with the utility meter 122 clock.

The estimator 750 estimates or generates an estimated bill 752 for a period-to-date. A period-to-date may be a billing period (e.g., a month) or some other period. In some configurations, the estimator 750 computes the estimated bill 752 based on rates 709, usage 707 (records) and/or indices 711. The estimator 750 may communicate with the utility meter 122 and/or the utility system 102 using the communication interface 778. For example, the estimator 750 may send information to and/or receive information from the communication interface 778. For instance, the estimator 750 may request a usage 707 measurement from the utility meter 122 or an actual bill 774 from the utility system 102 via the communication interface 778. The rates 709 may be actual rates (obtained from the utility system 102, for example), estimated rates (obtained from the utility system 102, based on a schedule, or estimated based on past data, for example) or may include both one or more actual and/or estimated rates. The usage 707 may be actual usage (obtained from the utility system 102, for example), estimated usage (obtained from the utility meter 122, for example) or may include both actual and/or estimated usage (records). The rates 709 and usage 707 may be estimates or deemed "estimated" when they may not accurately reflect the actual rates and/or actual usage as used by the utility system 102, for example.

For example, estimated usage 707 records may be obtained from the utility meter 122. Actual usage 707 records may be obtained from the utility system 102. Estimated rates 709 may be obtained, for example, when the exact time (used for computing an actual bill by the utility system 102) of a rate change is unknown (e.g., caused by network latencies or lack of clock synchronization) and/or when the exact rate (used for computing an actual bill by the utility system 102) is unknown. Actual rates 709 may be obtained when a rate is specified by the utility system 102 over a known period of time and/or when corresponding to an actual usage measurement (used by the utility system 102), for example.

The estimated bill 752 may be determined by the estimator 750. More specifically, the estimator 750 attempts to estimate the bill computed by the utility system 102. The estimator 750 may obtain usage 707 (and/or rates 709) from the utility meter 122 and/or utility system 102. For example, in some configurations, the utility system 102 may provide rates to the utility meter 122, which may be obtained by the electronic device 744. In another configuration, the estimator 750 may have preprogrammed rates 709. However, the electronic device 744 may update the rates 709 when newer rate information (e.g., schedules) is available from the utility system 102. In some configurations, the estimator 750 may obtain rates (e.g., schedules) 709 from the utility system 102 (independent of the utility meter 122). In general, estimated and/or actual usage 707 records may be obtained from the utility system 102 and/or utility meter 122. Furthermore, estimated and/or actual rates 709 may be obtained from the utility system 102 and/or utility meter 122.

The estimator 750 may estimate or generate the estimated bill 752 based on the usage 707 (records), the rates 709, indices 711 (e.g., sample numbers) and/or any actual bill 774 information as illustrated in Equation (1). For example, an actual bill 774 for any known time period (within a billing cycle or period, for example) may be used in combination with rates 709 and usage 707 to compute the estimated bill 752. More detail is given above in connection with FIG. 5. It should be noted that an index 711 number may correspond to each sample of usage 707, rate 709 and/or bill 774. For example, each time a usage estimate 707 or rate estimate 709 is obtained, an index 711 number is generated for that sample. Similarly, each time an actual bill 774, actual usage 707 and/or actual rate 709 is obtained, an index 711 number is generated for that sample. In some configurations, index 711 numbers may correspond to particular times (e.g., when time stamps are used, in order to synchronize only up to a period for which an actual bill 774 is valid).

The synchronizer 768 may communicate with the utility system 102 to obtain an actual bill 774, actual usage 707 (records) and/or actual rates 709. The synchronizer 768 may provide this information to the estimator 750. The synchronizer 768 may communicate information with the communication interface 778 in order to accomplish this. For example, the synchronizer 768 may communicate with the utility system 102 independent of the utility meter 122 to obtain an actual bill 774. Additionally or alternatively, the synchronizer 768 may obtain the actual bill 774 indirectly through the utility meter 122. The actual bill 774 may be the current total amount to be charged for a period-to-date. For example, throughout a month (or other billing cycle) the actual bill at the utility system 102 accrues until the end of the billing cycle.

The consuming device control block/module 792 may be used to control one or more consuming devices 142 based on information from the estimator 750 (e.g., estimated bill 752, actual bill 774, usage 707, rates 709 and/or indices 711). For example, a user may have an option to control consuming devices 142 in his/her home based on the estimated bill 752. In one configuration, the consuming device control 792 may lower the resource consumption of one or more consuming devices 142 if the estimated bill 752 crosses a threshold or is projected to cost more than a threshold amount in a period (e.g., billing cycle). For instance, the consuming device control 792 may control consuming devices 142 in order to not exceed a particular dollar amount in a billing cycle. In one configuration, the consuming device control block/module 792 turns a thermostat up (to reduce air conditioning usage) or down (to reduce furnace usage) in order to reduce resource usage costs. Additionally or alternatively, the consuming device control block/module 792 may control lights, appliances, electronics, etc. based on estimator 750 information. This may be done using a set range, a threshold, a rationing program or some other scheme that controls resource consumption (e.g., based on the estimated bill 752).

The notification configuration block/module 794 may be used to notify a user based on estimator information. More specifically, the notification configuration block/module 794 may control how and/or when a notification is provided to a user. For example, the notification configuration block/module 794 may notify a user when a threshold estimated bill 752 has been reached. The user may be notified according to a period that may be adjustable by a user according to the notification configuration block/module 794. The notification configuration block/module 794 may additionally or alternatively control how a user is notified. For example, the notification configuration block/module 794 may send an email to a user, play a recording on a phone call to a user, send a text message to a user, flash an indicator light for a user (e.g., turn on a red light if a threshold for the estimated bill 752 is or is projected to be exceeded), update a website (e.g., a social networking website) for a user, etc.

The multi-utility configuration block/module 796 may be used to configure the electronic device 744 to function with multiple utility meters 122. For example, the electronic device 744 may be configured to function with an electricity meter, a water meter and a gas meter using the multi-utility configuration block/module 796. The multi-utility configuration block/module 796 may include settings and/or instructions used to interface with and use data from multiple utility meters 122. This may allow the electronic device 744 to estimate bills for each of the utility meters 122 that the electronic device 744 communicates with. For example, the settings and/or instructions from the multi-utility configuration block/module 796 may be provided to the synchronizer 768 and/or the estimator 750 in order to manage synchronization, estimation and/or recordkeeping (e.g., of an estimated bill 752, an actual bill 774, usage 707 records, rates 709 and/or indices 711) for each of the utility system 102 and/or utility meters 122 the electronic device 744 is configured to work with. These settings and/or instructions may be modifiable by a user. Additionally or alternatively, the multi-utility configuration block/module 796 may receive signals or messages from one or more utility systems 102 and/or one or more utility meters 122 to manage multiple utilities. For example, an electricity meter may send usage 707 measurements with an indicator specifying that it is a measurement of electricity, while a water company may send an actual bill specifying that the bill is for water, etc.

The synchronization scheduling block/module 798 may be used to configure synchronization. For example, the synchronization scheduling block/module 798 may include settings and/or instructions that schedule when and/or how often synchronization occurs. For instance, the synchronization scheduling block/module 798 may be used to set or adjust the frequency of synchronization (e.g., how often the synchronizer 768 obtains data from the utility system 102). It 798 may additionally or alternatively be used to set or adjust a schedule such as dates, times, days of the week, years, seasons, etc. for when synchronization occurs (or is attempted).

The synchronization scheduling block/module 798 may include different settings for different periods. For example, the electronic device 744 may be configured to synchronize at different times and/or frequencies for different utility systems 102. For instance, the billing period for electricity may be different from the billing period for water. Furthermore, the user of the electronic device 744 may be more concerned about accuracy in an estimated bill 752 for electricity than for water. Additionally or alternatively, the synchronization scheduling block/module 798 may be used to synchronize according to different schedules or frequencies at different times of the year. For example, a user may want the electronic device 744 to synchronize more often during winter months, when utility (e.g., electricity, gas, etc.) consumption may be higher than other times of the year.

The synchronization scheduling block/module 798 may also be used to schedule communications with one or more utility systems 102. For example, a utility system 102 may only allow access at particular times due to bandwidth constraints. For instance, a utility system 102 may only allow access to an actual bill once a week since bandwidth across a mesh network of utility meters 122 may be limited. The synchronization scheduling block/module 798 may be configured by a user. Alternatively, the synchronization scheduling block/module 798 may receive a message or signal from a utility system 102 indicating when and/or how often the electronic device 744 may access or retrieve (actual) usage 707, rates 709, bills 774, etc. In some configurations, such a message or signal may override user configuration instructions if they are incompatible (e.g., a user wants the electronic device 744 to synchronize once an hour but only once a day is permitted by a utility system 102). Furthermore, other triggers may be used to initiate synchronization with a utility 102. For example, the synchronization scheduling block/module 798 may be configured to synchronize when a certain amount of usage 707 is indicated by the estimator 750.

The security control block/module 701 may be used to handle authentication and/or security protocols and/or procedures. This may be done for multiple utility systems 102 and/or utility meters 122. For example, utility systems 102 and/or utility meters 122 may require authentication and/or other security protocols to allow access to information (e.g., usage measurements, rates, bills, etc.). For example, a utility system 102 website may require a username and password from the electronic device to access actual bill information. Additionally or alternatively, particular security protocols may be required for access. In one configuration, a particular type of encryption may be required for communication with a utility system 102 and/or utility meter 122. For instance, a utility system 102 may require that the electronic device 744 use Hypertext Transfer Protocol Secure (HTTPS), Transport Layer Security (TLS), Secure Socket Layer (SSL) and/or other security protocols. The security control block/module 701 may include instructions used for handling these authentication and/or security procedures and/or protocols. The security control block/module 701 may allow a user to enter information (e.g., username, password, account number, address, etc.) used in these procedures and/or protocols. The security control block/module 701 may provide information and/or instructions to the synchronizer 768 in order to access utility system 102 and/or utility meter 122 information. Additionally or alternatively, the security control module 701 may receive signals or information 713 from one or more utility systems 102 and/or one or more utility meters 122 for controlling authentication and/or security.

The communication configuration block/module 703 may provide communication procedures and/or protocols for one or more utility systems 102 and/or one or more utility meters 122. For example, the communication configuration block/module 703 may include instructions used to communicate according to one or more protocols, such as Institute of Electronics and Electrical Engineers (IEEE) 802.11 ("Wi-Fi") standards, Zigbee, Bluetooth, Global System for Mobile Communications (GSM), Third Generation Partnership Project (3GPP) standards, infrared, Ethernet, Universal Serial Bus (USB), Transmission Control Protocol (TCP), Internet Protocol (IP) and/or other communication protocols (at one or more layers).

The communication configuration block/module 703 may additionally or alternatively be used to choose different modes of communication with one or more utility systems 102 and/or one or more utility meters 122. For example, the communication configuration block/module 703 may allow a selection of communication modes. For instance, the electronic device 744 may select communication with a utility system 102 over the Internet, over a utility meter 122 mesh network, over a telephone landline or over a cellular tower. A user may configure this according to preference. Additionally or alternatively, the communication configuration block/module 703 may determine the mode that offers the fastest and/or most frequent access. Additionally or alternatively, the communication configuration block/module 703 may receive signals and/or instructions 713 from one or more utility systems 102 and/or one or more utility meters 122 that specify or request a particular kind of communication configuration (e.g., protocol, procedure, medium, etc.).

The meter read scheduling block/module 705 may be used to configure the electronic device 744 to retrieve information 713 from one or more utility meters 122. For example, the meter read scheduling block/module 705 may include settings and/or instructions that schedule when and/or how often a utility meter 122 is read. For instance, the meter read scheduling block/module 705 may be used to set or adjust the frequency of information 713 retrieval from a utility meter 122. It 705 may additionally or alternatively be used to set or adjust a schedule such as dates, times, days of the week, years, seasons, etc. for when utility meter 122 information is retrieved.

The meter read scheduling block/module 705 may include different settings for different periods. For example, the electronic device 744 may be configured to retrieve information 713 at different times and/or frequencies from different utility meters 122. Furthermore, the user of the electronic device 744 may be more concerned about currency in an estimated bill 752 for electricity than for water. Additionally or alternatively, the meter read scheduling block/module 705 may be used to retrieve information 713 according to different schedules or frequencies at different times of the year. For example, a user may want the electronic device 744 to retrieve usage measurements 707 more often during winter months, when utility (e.g., electricity, gas, etc.) consumption may be higher than other times of the year.

The meter read scheduling block/module 705 may also be used to schedule communications with one or more utility meters 122. For example, a utility meter 122 may only allow access at particular times due to bandwidth constraints. For instance, a utility meter 122 may only allow access to usage measurements once an hour. The meter read scheduling block/module 705 may be configured by a user. Alternatively, the meter read scheduling block/module 705 may receive a message or signal from a utility meter 122 indicating when and/or how often the electronic device 744 may access or retrieve (estimated) usage 707, rates 709, etc. In some configurations, such a message or signal may override user configuration instructions if they are incompatible (e.g., a user wants the electronic device 744 to retrieve information 713 once a minute but only once an hour is permitted by a utility meter 122).

Figure 8:
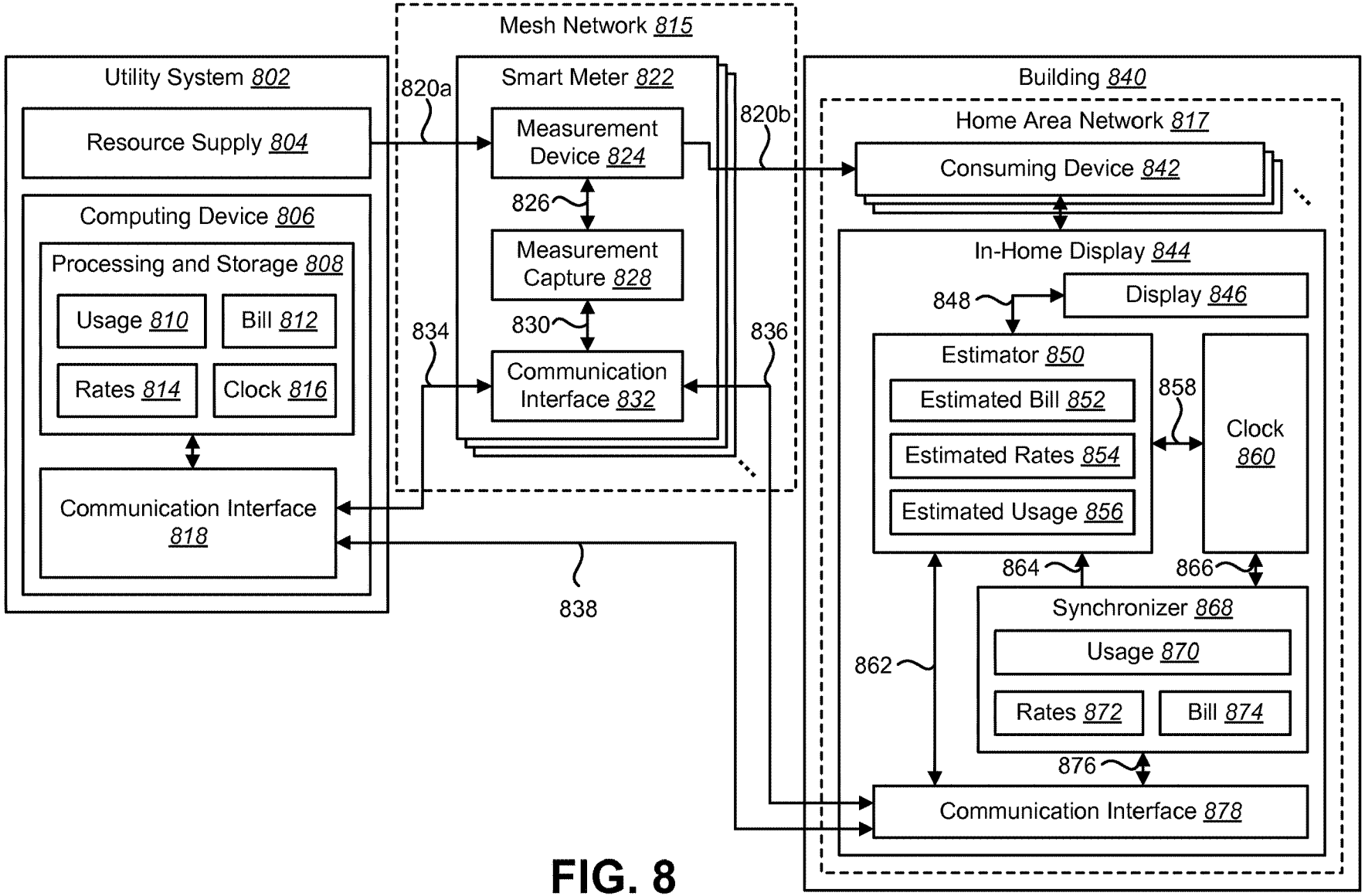
FIG. 8 is a block diagram illustrating one configuration of an In-Home Display (IHD) in which systems and methods for synchronizing a cost estimate may be implemented.

FIG. 8 is a block diagram illustrating one configuration of an In-Home Display (IHD) 844 in which systems and methods for synchronizing a cost estimate may be implemented. FIG. 8 also illustrates a utility system 802, one or more smart meters 822 and a building 840. Much of the functionality illustrated in FIG. 8 may be similar to that discussed in connection with FIG. 1 above. The utility system 802 may be an entity that provides a resource and/or charges or bills for resource usage. Examples of a utility system 802 include an electric company, natural gas company, water company, etc. Although a signal utility system 802 is illustrated in FIG. 8, one or more utility systems 802 may be used at a time according to the systems and methods disclosed herein.

The utility system 802 may include a resource supply 804 and a computing device 806. The resource supply 804 may be an entity that provides a particular resource, such as electricity, water, natural gas, oil, etc. The resource supply 804 may be coupled to one or more smart meters 822. The resource 820*a* may be conveyed to the smart meter 822. The resource 820*b* may then be provided to the building 840.

The computing device 806 may be a device that is used to track resource usage or consumption. The computing device 806 may also be used to bill consumers of the resource or utility. Examples of the computing device 806 include one or more desktop computers, laptop computers, servers, etc. The computing device 806 may include a processing and storage block/module 808 and a communication interface 818. The processing and storage block/module 808 may be implemented as hardware, software or a combination of both. For example, the processing and storage block/module 808 may comprise one or more processors, memory, software and/or other components. In one configuration, the processing and storage block/module 808 includes rates 814, usage 810, a bill 812 and a clock 816.

A rate 814 is the amount of money charged for a particular amount of a resource consumed. Rates 814 may vary. As discussed above, the rates 814 may vary according to a time model, a demand model, a hybrid of both, or others. Usage 810 is the utility system's 802 measurement of resource usage of the building 840. The utility system 802 may measure that usage 810. For example, an electric company records the electricity usage 810 of a building 840. The utility system 802 may apply its rates 814 to the usage 810 of a particular building 840 in order to generate a bill 812. A bill 812 may represent the cost for the resource usage 810 at the building 840. In some configurations, the processing and storage block/module 808 may include a clock 816. The clock 816 may be used to time stamp a usage 810 measurement, determine the beginning and/or end of a billing cycle, determine the time of a rate 814 change, etc. Thus, in some configurations, the bill 812 may be based on the timing provided by the clock 816.

The communication interface 818 may be a block/module used to communicate with other devices. The communication interface 818 may be implemented in hardware, software or a combination of both. The communication interface 818 included in the utility system 802 may communicate with other devices. For example, the communication interface 818 may send information 834 to and/or receive information 834 from the one or more smart meters 822. Additionally or alternatively, the communication interface 818 may send information 838 to and/or receive information 838 from the building 840.

The communication interface 818 may communicate with the building 840. For example, in one configuration, the utility system 802 communicates information 834, 836 with the building 840 through a mesh network 815 of one or more smart meters 822. In another configuration, the utility system 802 communicates information 838 with the building 840 independent of the mesh network 815 of smart meters 822. In yet another configuration, the utility system 802 may communicate one or more kinds of information 834, 836, 838 with the building 840 both through the mesh network of smart meters 822 and/or independent of the mesh network 815 of smart meters 822. It should be noted that information 834 communicated between the utility system 802 and smart meter 822, information 836 communicated between the smart meter 822 and the building 840 and/or information 838 communicated between the utility system 802 and the building 840 (independent of the smart meter 822) may be the same or different.

The mesh network 815 may be a communication network comprising one or more smart meters 822. In the mesh network 815, communication traffic may be routed through one or more smart meters 822. For example, each smart meter 822 may communicate with one or more other smart meters 822. Thus, the utility system 802 (e.g., computing device 806) may communicate with one or more smart meters 822 through the mesh network 815 of smart meters 822. In some configurations, the mesh network 815 may also be used for communications between the computing device 806 and one or more In-Home Displays (IUDs) 844. In other words, messages or signals may be sent between the computing device 806 and one or more In-Home Displays 844 using the mesh network 815. In some configurations, the mesh network 815 of smart meters 822 may also be used by an In-Home Display 844 to communicate with one or more smart meters 822. In some configurations, the mesh network 815 may operate according to one or more standards or protocols such as Ethernet, Zigbee, Bluetooth, IEEE 802.11 ("Wi-Fi"), 3GPP, GSM, etc.

The smart meter 822 may be a device that measures and provides measurements (e.g., data) of resource consumption or usage 810. Examples of the smart meter 822 include electricity meters, water meters and gas meters, etc. The smart meter 822 may include a measurement device 824, a measurement capture block/module 828 and/or a communication interface 832. The measurement device 824 may be a device that measures resource usage 810 or consumption. As discussed above, one or more smart meters 822 may be used at a time according to the systems and methods disclosed herein.

The measurement device 824 provides usage measurements 826 to the measurement capture block/module 828. The measurement capture block/module 828 may be implemented in hardware and/or software. The measurement capture block/module 828 captures (e.g., receives, stores, etc.) the usage measurements 826 provided by the measurement device 824. In some configurations, the measurement capture block/module 828 includes a clock (not shown in FIG. 8). The clock may be used to time stamp the measurements taken from the measurement device 824, to schedule/determine when to take measurements and/or to schedule/determine when to report measurements, for example.

The measurement capture block/module 828 may provide measurements and/or other information 830 to the communication interface 832. The communication interface 832 may communicate information 834 with the utility system 802 and may communicate information 836 with the building 840. For example, the communication interface 832 may communicate resource usage measurements and/or other information 834 to the utility system 802 and/or may communicate resource usage measurements and/or other information to the building 840. These communications may be performed directly and/or using the mesh network 815 (e.g., through one or more smart meters 822). Additionally or alternatively, the communication interface 832 may relay information 834, 836 between the utility system 802 and the building 840. This may be done directly and/or through one or more smart meters 822 using the mesh network 815. Requests for resource usage measurements may additionally or alternatively be received by the communication interface 832 (from the utility system 802 and/or the building 840). For example, a request may be provided to the measurement capture block/module 828, which may provide a usage measurement 830 to the communication interface 832 for transmission to the utility system 802 and/or to the building 840.

The utility system 802 may measure resource usage 810 by communicating with or "reading" the smart meter 822. The utility system 802 may communicate with the smart meter 822, such that it may take usage 810 measurements (e.g., remotely take measurements). That is, the smart meter 822 may measure and/or record the resource usage 810 of a building 840. The utility system 802 and/or building 840 may request the usage 810 measurement or the smart meter 822 may transmit it (to the utility system 802 and/or building 840) without a request. These usage measurements may be communicated to the utility system 802 on a fixed schedule or alternatively, when certain conditions are met (e.g., a usage measurement is requested, a certain amount of usage has occurred, when bandwidth is available to make the communication, etc.). In one configuration, the utility system 802 may transmit the rates 814 to the smart meter 822, such that the rates 814 are stored on the smart meter 822. Additionally or alternatively, the utility system 802 may notify the smart meter 822 that a rate 814 change has occurred. In some configurations, these communications may be performed using the mesh network 815.

The building 840 may be a place where a resource is consumed (and possibly measured, for example). This building 840 may include one or more consuming devices 842. The consuming devices 842 may include any device that consumes a resource (e.g., electricity, water, gas, etc.). Although a single building 840 is illustrated in FIG. 8, one or more buildings 840 (or other places) may be used at a time according to the systems and methods disclosed herein.

The building 840 may include an In-Home Display (IUD) 844. Examples of the In-Home Display 844 include computing devices, wall-mounted devices, desktop computers, laptop computers, tablet devices, thermostats, controls, etc. The In-Home Display 844 may monitor the resource usage (e.g., overall consumption, consumption patterns, etc.) of the building 840 (e.g., consuming devices 842). In some configurations, the In-Home Display 844 may control the consuming devices 842.

One or more of the consuming devices 842 and/or the In-Home Display 844 may be included within a Home Area Network (HAN) 817. The Home Area Network 817 may facilitate communications between one or more of the consuming devices 842 and the In-Home Display 844. For example, the In-Home Display 844 may use the Home Area Network 817 to communicate with and/or control one or more of the consuming devices 842. For example, the In-Home Display 844 may adjust a thermostat, turn off a television, dim lights, etc. In some configurations, the In-Home Display 844 controls the consuming devices 842 based on the estimated bill 852. For instance, the thermostat may be adjusted when the estimated bill 852 reaches a threshold or is projected to exceed a certain amount in a billing period.

In one configuration, the In-Home Display 844 may also take estimated usage 856 measurements directly from the one or more consuming devices 842 using the Home Area Network 817. This may be done in addition to or alternatively from estimated usage 856 retrieved from the smart meter 822. In some configurations for example, a smart meter 822 may not be available to retrieve estimated usage 856 measurements. For example, a building 840 may not have a smart meter 822 for water installed, although the water-consuming devices 842 may be able to provide estimated usage 856 measurements. In another example, the smart meter 822 may only provide estimated usage 856 measurements at intervals that are longer than desired. For instance, a smart meter 822 (in one configuration) may only provide an estimated usage 856 measurement once per billing cycle. Thus, the In-Home Display 844 may retrieve estimated usage 856 from the one or more consuming devices 842 in some configurations.

In one configuration, the Home Area Network 817 may additionally or alternatively facilitate communications between the In-Home Display 844 and the smart meter 822 (e.g., using the mesh network 815) and/or between the In-Home Display 844 and the utility system 802. The Home Area Network 817 may be implemented in many configurations. For example, the Home Area Network 817 may comprise a wireless or wired router, hubs, switches and/or other devices. Some configurations of the Home Area Network 817 may operate according to one or more standards or protocols such as Ethernet, IEEE 802.11 ("Wi-Fi"), Bluetooth, USB, Zigbee, etc.

The In-Home Display 844 may include a display 846, estimator 850, clock 860, synchronizer 868 and/or communication interface 878. The display 846 may be a device used to convey visual information. Examples of displays 846 include Liquid Crystal Displays (LCDs), Light-Emitting Diode (LED) displays (e.g., Active Matrix Organic LED (AMOLED) displays), Cathode Ray Tube (CRT) displays, touchscreens, monitors, etc. The display 846 may be used to present or display an estimated bill 852. For example, a user may use the In-Home Display 844 to view an estimated bill 852 for a period-to-date. More specifically, the estimator 850 may send estimated bill information 848 to the display 846 that can be used to render an image of the estimated bill 852.

The estimator 850 may be a block/module implemented in hardware, software or a combination of both. The estimator 850 may estimate or generate an estimated bill 852 for a period-to-date. The synchronizer 868 may be a hardware and/or software block/module used to synchronize the estimated bill 852 (for a period-to-date) with the actual bill 812 from the utility system 802. The communication interface 878 on the In-Home Display 844 may be used to communicate with other devices. For example, the communication interface 878 on the In-Home Display 844 may be used to communicate with the smart meter 822 and the utility system 802 (e.g., computing device 806). The clock 860 may be used for In-Home Display 844 operation. For example, the clock 860 may be used to schedule or determine when to synchronize the estimated bill 852 with the actual bill 812, when to obtain a usage measurement from the smart meter 822, etc. For example, the clock 860 may provide timing information 858 to the estimator 850 and/or timing information 866 to the synchronizer 868. The clock 860 may optionally be used for time stamping usage measurements.

The In-Home Display 844 may obtain (e.g., receive, store, etc.) usage measurements from the smart meter 822 (as part of communicated information 836, for example). Obtaining usage measurements may include recording a clock time. In one configuration, the In-Home Display 844 records a clock time from the smart meter 822. The In-Home Display 844 may optionally synchronize the local In-Home Display 844 clock 860 with the smart meter 822 clock, where the smart meter clock is the clock "master."

Having the In-Home Display 844 record the clock time from the smart meter 822 and/or synchronize the In-Home Display 844 clock 860 to a smart meter 822 clock is only one example of the systems and methods disclosed herein. Other procedures may be followed. For example, a clock time may be determined from the In-Home Display 844 clock 860 or some other source. Also, the In-Home Display 844 may not synchronize its clock 860 with the smart meter 822 clock or may only occasionally synchronize its clock with the smart meter 822 clock.

The estimator 850 estimates or generates an estimated bill 852 for a period-to-date. A period-to-date may be a billing period (e.g., a month) or some other period. In some configurations, the estimated bill 852 may be based on estimated rates 854 and/or estimated usage 856. The estimator 850 may communicate with the smart meter 822 and/or the utility system 802 using the communication interface 878. For example, the estimator 850 may send information 862 to and/or receive information 862 from the communication interface 878. For instance, the estimator 850 may request an estimated usage 856 measurement from the smart meter 822 or estimated rates 854 from the utility system 802 via the communication interface 878. The estimated rates 854 and estimated usage 856 may be estimates or deemed "estimated" as they may not accurately reflect the actual rates 814 and/or actual usage 810 as used by the utility system 802.

For example, the estimated usage 856 may be obtained from the smart meter 822. The estimated usage 856 may be an estimate since it may not be obtained at precisely the same time as the usage 810 obtained by the utility system 802. In one configuration, the utility system 802 rates 814 may vary based on a time of day. However, the In-Home Display 844 clock 860 may not be precisely synchronized with the computing device clock 816. Thus, the usage 810 measured by the utility system 802 and the estimated usage 856 measured by the In-Home Display 844 may be actually taken at different times. Other inaccuracies may be caused by a network latency (to communicate information 834) between the smart meter 822 and the utility system 802 that is different from a network latency (to communicate information 836) between the smart meter 822 and the In-Home Display 844.

The estimated rates 854 may be estimates for the same or other reasons. For example, the estimated rates 854 may only be considered estimates since their 854 timing or rate may be different from the rates 814 included on the computing device 806. In one configuration, a utility system 802 rate 814 may be based on current resource consumption. For example, the utility system 802 may monitor when total resource consumption (of the building 840 and other locations or consumers) crosses a threshold. For instance, the utility system 802 that provides electrical power may increase a rate 814 when a power plant (e.g., resource supply 804) is outputting more than a threshold number of watts. In some cases, the In-Home Display 844 may not be informed of the precise moment when this change in rate 814 occurs. In one configuration, the In-Home Display 844 may thus produce an estimated rate 854 based on past data. For instance, the change in rate 814 may occur at 9:17 a.m. on average. Thus, the estimator 850 may assume an estimated rate 854 when generating an estimated bill 852.

In another configuration, the estimated rates 854 may be considered estimates since the magnitude of the rate 814 may be unknown to the In-Home Display 844. For example, the rate 814 used for generating the bill 812 may be based on current consumption (of the building 840 and others). For instance, the rate 814 may vary based on the current resource consumption. In some configurations, the In-Home Display 844 may not have current resource consumption data, and may thus generate estimated rates 854 based on past data. Additionally or alternatively, the precise rate 814 may be unknown as a result of network latency or lack of synchronization between the utility system clock 816 and the electronic device clock 860. In the case where a smart meter 822 clock or time stamp is used, similar issues may occur (e.g., network latency, synchronization, etc.), leading to a lack of precise information on the usage 810 and/or rates 854 at the In-Home Display 844.

The estimated bill 852 may be determined by the estimator 850. More specifically, the estimator 850 attempts to estimate the bill 812 charged by the utility system 802. The estimator 850 may obtain estimated usage 856 (and/or estimated rates 854) from the smart meter 822. For example, in some configurations, the utility system 802 may provide rates 814 to the smart meter 822, which may be obtained by the In-Home Display 844. However, these may be estimated rates 854 at the In-Home Display 844 for the reasons described above. In another configuration, the estimator 850 may have preprogrammed estimated rates 854. However, the In-Home Display 844 may update the rates when newer rate information (e.g., schedules) is available from the utility system 802. In some configurations, the estimator 850 may obtain estimated rates (e.g., schedules) 854 from the utility system 802 (independent of the smart meter 822).

The estimated bill 852 may be generated (by the estimator 850) based on the estimated usage 856 obtained from the smart meter 822, the estimated rates 854, any actual bill 874 information, clock 860 times and/or other factors (e.g., usage patterns, bill patterns, etc.). For example, the estimator 850 may compute an estimated bill 852 by multiplying an estimated rate 854 with an estimated usage 856. Any actual bill data 874 that is available may also be used. For example, an actual bill 874 for any known time period (within a billing cycle or period, for example) may be used in combination with estimated rates 854 and estimated usage 856 for periods where the actual bill 874 is unknown. In one configuration, the In-Home Display 844 may take usage measurements 856 (directly) from the consuming devices 842.

The synchronizer 868 may communicate with the utility system 802 to obtain actual usage 870, actual rates 872 and/or actual bill 874 information. The synchronizer 868 may provide the actual usage 870, actual rates 872 and/or actual bill 874 information 864 to the estimator 850. The synchronizer 868 may communicate information 876 with the communication interface 878 in order to accomplish this. For example, the synchronizer 868 may communicate with the utility system 802 independent of the smart meter 822 to obtain an actual bill 874. Additionally or alternatively, the synchronizer 868 may obtain the actual bill 874 indirectly through the smart meter 822. The actual bill 874 may be the current total amount to be charged to the building 840 for a period-to-date. For example, throughout a month (or other billing cycle) the actual bill 812 at the utility system 802 accrues until the end of the billing cycle. The bill 812 for the month (or other billing cycle) may then be communicated to the building 840 (through mail, e-mail, an Internet website and/or through the In-Home Display 844, for example).

The actual bill 874 (for a period-to-date) may be obtained at a scheduled time or when requested (e.g., by the synchronizer 868 or on demand of a user). Alternatively or additionally, the actual bill 874 (for a period-to-date) may be sent when bandwidth is available for communication or when some other condition or trigger occurs (e.g., when a certain amount of resources has been consumed). In some configurations, the synchronizer 868 may follow authentication or security protocols in order to obtain the actual bill 874. In one configuration, the synchronizer 868 sends a user name and password to the utility system 802, which then allows access to the actual bill 812. In another configuration, the synchronizer 868 sends and/or receives encrypted data to or from the utility system 802 in order to obtain the actual bill 874. Once the actual bill 874 is received, the synchronizer 868 may send it to the estimator 850, which may use it to synchronize or adjust the estimated bill 852. In another configuration, only actual usage 870 and/or actual rates 872 may be provided by the utility system 802, in which case the synchronizer 868 may send the actual usage 870 and/or rates 872 to the estimator 850, which may use them to synchronize or adjust the estimated bill 852.

Figure 9:
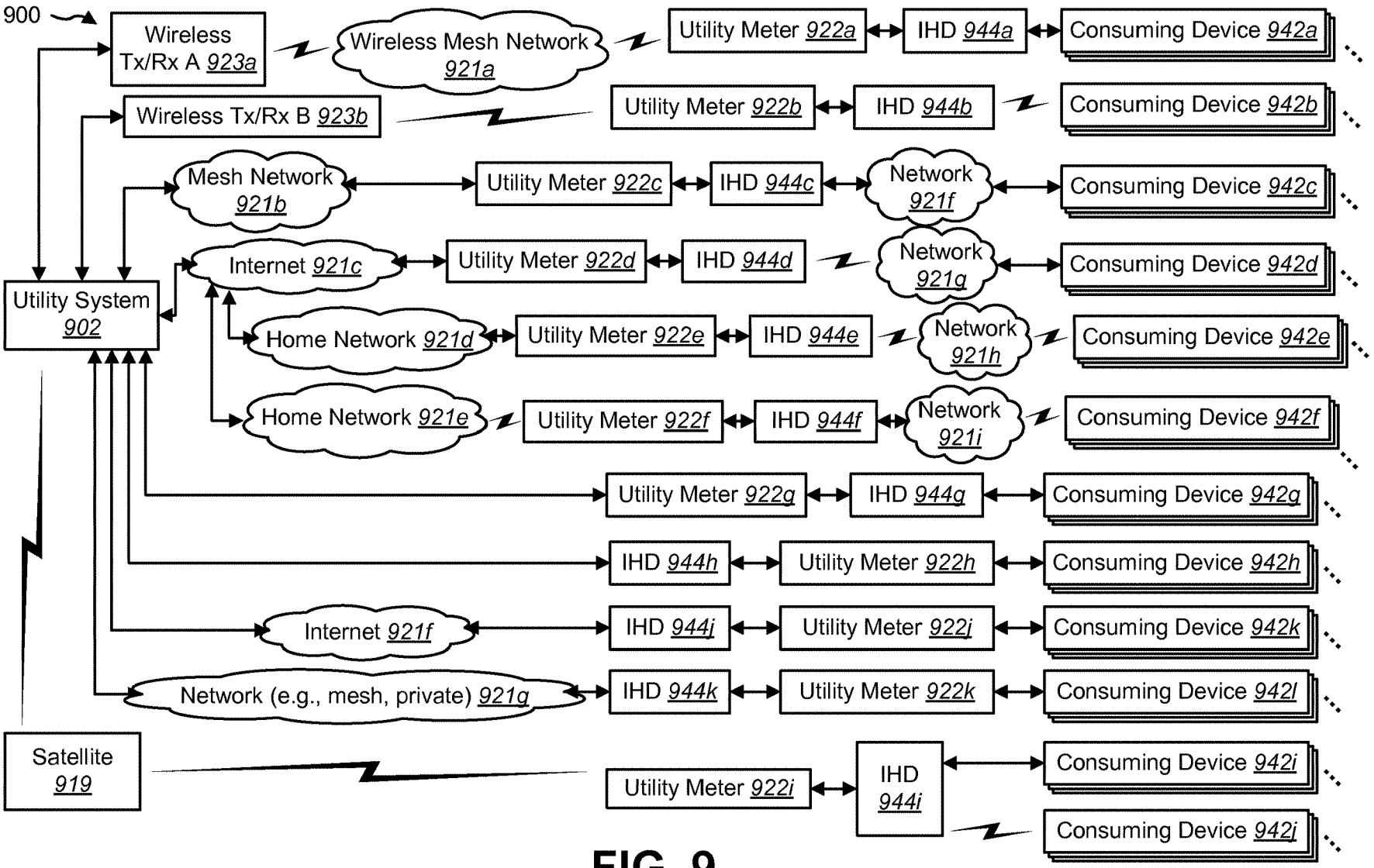
FIG. 9 is a block diagram illustrating several modes of communication that may be utilized in conjunction with systems and methods for synchronizing a cost estimate on an electronic device.

FIG. 9 is a block diagram illustrating several modes of communication 900 that may be utilized in conjunction with systems and methods for synchronizing a cost estimate on an electronic device. A utility system 902 may communicate with one or more a utility meters 922*a-k* and/or In-Home Displays (abbreviated as "IUDs" for convenience) 944*a-k* through many different modes of communication. That is, the utility system 902 may transmit and/or receive rate, usage and/or bill data to or from utility meters 922 and/or IHDs 944 using various modes of communication. The utility system 902 may communicate with an IHD 944 and/or a utility meter 922. In some cases, the utility system 902 may communicate with an IHD 944 using a utility meter 922 and/or may communicate with a utility meter 922 using an IHD 944. In one configuration, the utility system 902 uses a wireless transceiver (Tx/Rx) module A 923*a*. The wireless Tx/Rx module A 923*a* may communicate using cell phone towers, base stations, Wi-Fi® (e.g., Institute of Electrical and Electronics Engineers (IEEE) 802.11) stations, WiMax® stations, BlueTooth® devices, infrared transceivers, or other devices that send and receive data using a wireless transmission medium. In this case, the wireless Tx/Rx module A 923*a* may wirelessly communicate with a utility meter 922*a* over the wireless mesh network 921*a*. In another configuration, the utility system 902 uses the wireless Tx/Rx module B 923*b* that wirelessly communicates directly with a utility meter 922*b*. In yet another configuration, the utility system 902 communicates with a utility meter 922*c* using a wired mesh network 921*b*.

The utility system 902 may also communicate with a utility meter 922*d* over the Internet 921*c*. For example, the utility meter 922*d* may use a cable Internet modem (modulator/demodulator) via an Ethernet connection. Another alternative is where a utility meter 922*e* communicates with the utility system 902 via a wired home network 921*d* which provides access to the Internet 921*c*. Yet another alternative is where a utility meter 922*f* communicates with a home network 921*e* wirelessly (e.g., using Wi-Fi®, Bluetooth®, etc.), which provides access to the Internet 921*c*, and thus establishes communication between the utility system 902 and the utility meter 922*f*.

Another option is where the utility system 902 directly communicates with a utility meter 922*g* using a wired connection. The utility system 902 may also directly communicate with an IHD 944*h*, or may even communicate with a utility meter 922*h* via the IHD 944*h*. Another option is where the utility system 902 may communicate with an IUD 944*j* (and/or a utility meter 922*j*) using the Internet 921*f*. In another configuration, the utility system 902 may communicate with an IHD 944*k* (and/or utility meter 922*k*) using another network 921*g*, such as a mesh network and/or a private network (e.g., GSM, business-to-business, home network, etc.). It should be noted that this other network 921*g* may use wired and/or wireless connections. Yet another option is where the utility system 902 may communicate with a utility meter 922*i* using a satellite 919.

As illustrated in FIG. 9, one or more IHDs 944*a-k* and/or utility meters 922*a-k* may communicate with consuming devices 942*a-l* directly with a wired or wireless connection, or indirectly through a network 921*f-i* using different combinations of wired and/or wireless connections. In one configuration, an IHD 944*i* (or utility meter 922) may communicate with some consuming devices 942*i* using a wired connection while communicating with other consuming devices 942*j* using a wireless connection.

Figure 10:
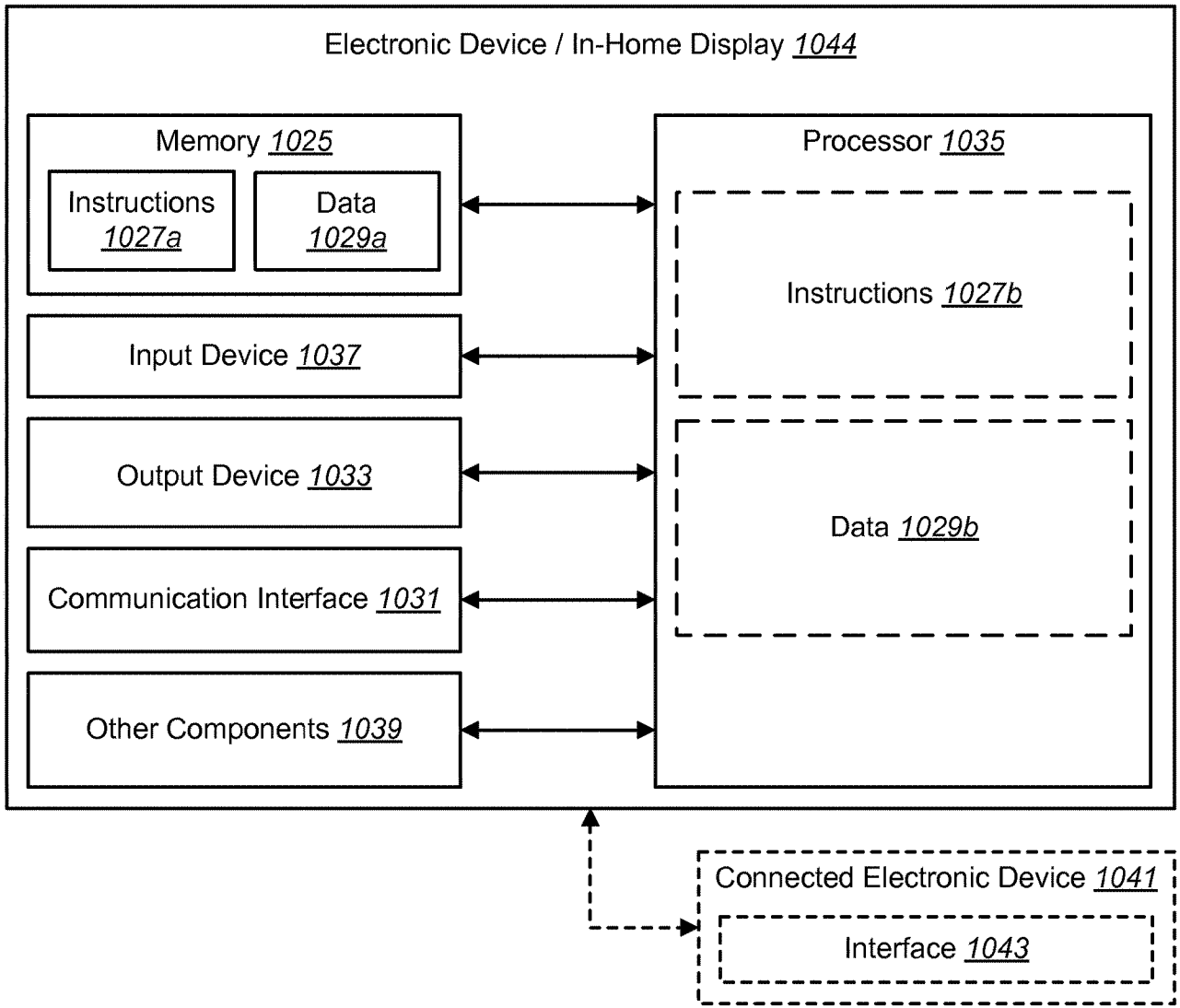
FIG. 10 is a block diagram illustrating various components that may be utilized in an electronic device and/or In-Home Display (IHD).

FIG. 10 is a block diagram illustrating various components that may be utilized in an electronic device and/or In-Home Display (IHD) 1044. Thus, although only an electronic device and/or In-Home Display 1044 is shown, the configurations herein may be implemented in a distributed system using many electronic and/or computing devices. The electronic device and/or In-Home Display 1044 may include the broad range of digital computers including microcontrollers, hand-held computers, personal computers, servers, mainframes, supercomputers, minicomputers, workstations, and any variation or related device thereof. In some configurations, the electronic device and/or In-Home Display 1044 may be an embedded device.

The electronic device and/or In-Home Display 1044 is shown with a processor 1035 and memory 1025. The processor 1035 may control the operation of the electronic device and/or In-Home Display 1044 and may be embodied as a microprocessor, a microcontroller, a digital signal processor (DSP) or other device known in the art. The processor 1035 typically performs logical and arithmetic operations based on program instructions 1027*a* and/or data 1029*a* stored within the memory 1025. The instructions 1027*a* in the memory 1025 may be executable to implement the methods described herein.

The memory 1025 may be any electronic component capable of storing electronic information. The memory 1025 may be embodied as random access memory (RAM), read only memory (ROM), magnetic disk storage media, optical storage media, flash memory devices in RAM, on-board memory included with the processor, EPROM memory, EEPROM memory, an ASIC (Application Specific Integrated Circuit), registers, and so forth, including combinations thereof.

Data 1029*a* and instructions 1027*a* may be stored in the memory 1025. The processor 1035 may load and execute instructions 1027*b* from the instructions 1027*a* in memory 1025 to implement various functions. Executing the instructions 1027*a* may involve the use of the data 1029*a* that is stored in the memory 1025. Data 1029*b* may be loaded onto the processor 1035. The instructions 1027 are executable to implement one or more of the methods 300, 400, 500 illustrated herein and the data 1029 may include one or more of the various pieces of data described herein.

The electronic device and/or In-Home Display 1044 may also include one or more communication interfaces 1031 for communicating with other electronic devices. The communication interface(s) 1031 may be based on wired communication technology, and/or wireless communication technology, such as ZigBee®, WiMax®, Wi-Fi®, Bluetooth®, and/or cellular protocols, such as GSM®, etc.

The electronic device and/or In-Home Display 1044 may also include one or more input devices 1037 and one or more output devices 1033. The input devices 1037 and output devices 1033 may facilitate user input/user output. Examples of input devices 1037 include touchscreens, keyboards, mice, cameras, microphones, etc. Examples of output devices 1033 include displays, speakers, tactile devices, etc. Other components 1039 may also be provided as part of the electronic device and/or In-Home Display 1044.

Optionally, the electronic device and/or In-Home Display 1044 may communicate with a connected electronic device 1041. The connected electronic device 1041 may provide an interface 1043 for interacting with the electronic device and/or In-Home Display 1044. For instance, the interface 1043 may be browser program. This interface 1043 may additionally or alternatively be a Graphical User Interface (GUI) that enables a user to interact with the electronic device and/or In-Home Display 1044. For example, the electronic device and/or In-Home Display 1044 may not include a display at all. In some configurations, the electronic device and/or In-Home Display 1044 may provide a web interface accessible by a connection electronic device 1041. Thus, the connected electronic device 1041 may present an interface 1043 on a display that is included in the connected electronic device 1041 and/or coupled to the connected electronic device 1041. Examples of the connected electronic device 1041 include desktop computers, laptop computers, tablet devices, smart phones, etc. It should be noted that the connected electronic device 1041 may communicate with the electronic device and/or In-Home Display 1044 using a wired and/or wireless connection.

In the above description, reference numbers have sometimes been used in connection with various terms. Where a term is used in connection with a reference number, this is meant to refer to a specific element that is shown in one or more of the Figures. Where a term is used without a reference number, this is meant to refer generally to the term without limitation to any particular Figure.

The term "determining" encompasses a wide variety of actions and, therefore, "determining" can include calculating, computing, processing, deriving, investigating, looking up (e.g., looking up in a table, a database or another data structure), ascertaining and the like. Also, "determining" can include receiving (e.g., receiving information), accessing (e.g., accessing data in a memory) and the like. Also, "determining" can include resolving, selecting, choosing, establishing and the like.

The phrase "based on" does not mean "based only on," unless expressly specified otherwise. In other words, the phrase "based on" describes both "based only on" and "based at least on."

The term "processor" should be interpreted broadly to encompass a general purpose processor, a central processing unit (CPU), a microprocessor, a digital signal processor (DSP), a controller, a microcontroller, a state machine, and so forth. Under some circumstances, a "processor" may refer to an application specific integrated circuit (ASIC), a programmable logic device (PLD), a field programmable gate array (FPGA), etc. The term "processor" may refer to a combination of processing devices, e.g., a combination of a DSP and a microprocessor, a plurality of microprocessors, one or more microprocessors in conjunction with a DSP core, or any other such configuration.

The term "memory" should be interpreted broadly to encompass any electronic component capable of storing electronic information. The term memory may refer to various types of processor-readable media such as random access memory (RAM), read-only memory (ROM), non-volatile random access memory (NVRAM), programmable read-only memory (PROM), erasable programmable read only memory (EPROM), electrically erasable PROM (EEPROM), flash memory, magnetic or optical data storage, registers, etc. Memory is said to be in electronic communication with a processor if the processor can read information from and/or write information to the memory. Memory that is integral to a processor is in electronic communication with the processor.

The terms "instructions" and "code" should be interpreted broadly to include any type of computer-readable or processor-readable statement(s). For example, the terms "instructions" and "code" may refer to one or more programs, routines, sub-routines, functions, procedures, etc. "Instructions" and "code" may comprise a single computer- or processor-readable statement or many computer- or processor-readable statements.

The term "computer-readable medium" refers to any available medium that can be accessed by a computer or processor. By way of example, and not limitation, a computer-readable medium may comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Disk and disc, as used herein, includes compact disc (CD), laser disc, optical disc, digital versatile disc (DVD), floppy disk and Blu-ray® disc where disks usually reproduce data magnetically, while discs reproduce data optically with lasers. A computer-readable medium may be tangible and non-transitory.

Software or instructions may also be transmitted over a transmission medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of transmission medium.

The methods disclosed herein comprise one or more steps or actions for achieving the described method. The method steps and/or actions may be interchanged with one another without departing from the scope of the claims. In other words, unless a specific order of steps or actions is required for proper operation of the method that is being described, the order and/or use of specific steps and/or actions may be modified without departing from the scope of the claims.

It is to be understood that the claims are not limited to the precise configuration and components illustrated above. Various modifications, changes and variations may be made in the arrangement, operation and details of the systems, methods, and apparatus described herein without departing from the scope of the claims.

What is claimed is:

1. A method for synchronizing a cost estimate on an electronic device, the method comprising:

obtaining, by the electronic device at a house, an estimated usage from a utility meter at the house, wherein the electronic device is an in-home display that controls at least one consuming device at the house;

obtaining, by the electronic device, an estimated cost per resource unit for a period of time, wherein the estimated cost per resource unit differs from an actual cost per resource unit that is set by a utility system for the period of time;

estimating, on the electronic device, a bill for a period-to-date based on the estimated usage and the estimated cost per resource unit to produce an estimated bill;

determining, on the electronic device, whether to synchronize the estimated bill with actual bill information on the utility system based on a schedule received from the utility system that indicates how frequently the electronic device is allowed to access the actual bill information, wherein the received schedule allows electronic devices using a broadband network connection to access the utility system more frequently than electronic devices using a mesh network of utility meters; and synchronizing, on the electronic device at the house, the estimated bill using the actual bill information for the period-to-date in response to determining to synchronize, wherein the actual bill information comprises an actual bill, an actual usage and an actual cost per resource unit, wherein synchronizing the estimated bill using actual bill information for the period-to-date comprises:

sending authentication information to the utility system that is remote from the house;

requesting the actual bill information from the utility system;

receiving the actual bill information at the electronic device at the house from the utility system that is remote from the house; and using the actual bill information to synchronize the estimated bill, wherein synchronizing the estimated bill using the actual bill information for a period-to-date is performed according to the equation $$C_n = B_k + \sum_{i=k}^{n} U_i R_i \begin{cases} B_0 = 0 \\ U_{0,i=k} = 0 \\ k = 0 \text{ before synchronization} \\ k = n \text{ at synchronization} \end{cases},$$

wherein $C_n$ is the estimated bill for a period-to-date for a current sample number n, $B_k$ is an actual bill, k is a sample number when a most recent synchronization occurs, i is an index number, $U_i$ is the estimated usage for a sample corresponding to index i and $R_i$ is the estimated cost per resource unit for a sample corresponding to index i.

2. The method of claim 1, wherein synchronizing the estimated bill using actual bill information comprises adjusting the estimated bill to match an actual bill for a period-to-date.

3. The method of claim 1, wherein determining whether to synchronize is performed without user interaction.

4. The method of claim 1, wherein determining whether to synchronize is performed further based on user interaction.

5. The method of claim 1, wherein the estimated cost per resource unit differs from the actual cost per resource unit due to network latency.

6. The method of claim 1, wherein the estimated cost per resource unit differs from the actual cost per resource unit due to a lack of synchronization between a utility system clock and an electronic device clock.

7. An electronic device for synchronizing a cost estimate, the electronic device comprising:

a processor;

memory in electronic communication with the processor;

instructions stored in the memory, the instructions being executable to:

obtain, by the electronic device at a house, an estimated usage from a utility meter at the house, wherein the electronic device is an in-home display that controls at least one consuming device at the house;

obtain an estimated cost per resource unit for a period of time, wherein the estimated cost per resource unit differs from an actual cost per resource unit that is set by a utility system for the period of time;

estimate a bill for a period-to-date based on the estimated usage and the estimated cost per resource unit to produce an estimated bill;

determine whether to synchronize the estimated bill with actual bill information on the utility system based on a schedule received from the utility system that indicates how frequently the electronic device is allowed to access the actual bill information, wherein the received schedule allows electronic devices using a broadband network connection to access the utility system more frequently than electronic devices using a mesh network of utility meters; and synchronize, on the electronic device at the house, the estimated bill using the actual bill information for the period-to-date in response to determining to synchronize, wherein the actual bill information comprises an actual bill, an actual usage and an actual cost per resource unit, wherein synchronizing the estimated bill using actual bill information for the period-to-date comprises:

sending authentication information to the utility system that is remote from the house;

requesting the actual bill information from the utility system;

receiving the actual bill information at the electronic device at the house from the utility system that is remote from the house; and using the actual bill information to synchronize the estimated bill, wherein synchronizing the estimated bill using the actual bill information for a period-to-date is performed according to the equation $$C_n = B_k + \sum_{i=k}^{n} U_i R_i \begin{cases} B_0 = 0 \\ U_{0,i=k} = 0 \\ k = 0 \text{ before synchronization} \\ k = n \text{ at synchronization} \end{cases},$$

wherein $C_n$ is the estimated bill for a period-to-date for a current sample number n, $B_k$ is an actual bill, k is a sample number when a most recent synchronization occurs, i is an index number, $U_i$ is the estimated usage for a sample corresponding to index i and $R_i$ is the estimated cost per resource unit for a sample corresponding to index i.

8. The electronic device of claim 7, wherein synchronizing the estimated bill using actual bill information comprises adjusting the estimated bill to match an actual bill for a period-to-date.

9. The electronic device of claim 7, wherein determining whether to synchronize is performed without user interaction.

10. The electronic device of claim 7, wherein determining whether to synchronize is performed further based on user interaction.

11. A non-transitory computer-readable medium configured to synchronize a cost estimate, comprising executable instructions for:

obtaining, by an electronic device at a house, an estimated usage from a utility meter at the house, wherein the electronic device is an in-home display that controls at least one consuming device at the house;

obtaining an estimated cost per resource unit for a period of time, wherein the estimated cost per resource unit differs from an actual cost per resource unit that is set by a utility system for the period of time;

estimating a bill for a period-to-date based on the estimated usage and the estimated cost per resource unit to produce an estimated bill;

determining whether to synchronize the estimated bill with actual bill information on the utility system based on a schedule received from the utility system that indicates how frequently the electronic device is allowed to access the actual bill information, wherein the received schedule allows electronic devices using a broadband network connection to access the utility system more frequently than electronic devices using a mesh network of utility meters; and synchronizing, on the electronic device at the house, the estimated bill using the actual bill information for the period-to-date in response to determining to synchronize, wherein the actual bill information comprises an actual bill, an actual usage and an actual cost per resource unit, wherein synchronizing the estimated bill using actual bill information for the period-to-date comprises:

sending authentication information to the utility system that is remote from the house;

requesting the actual bill information from the utility system;

receiving the actual bill information at the electronic device at the house from the utility system that is remote from the house; and using the actual bill information to synchronize the estimated bill, wherein synchronizing the estimated bill using the actual bill information for a period-to-date is performed according to the equation $$C_n = B_k + \sum_{i=k}^{n} U_i R_i \begin{cases} B_0 = 0 \\ U_{0,i=k} = 0 \\ k = 0 \text{ before synchronization} \\ k = n \text{ at synchronization} \end{cases},$$

wherein $C_n$ is the estimated bill for a period-to-date for a current sample number n, $B_k$ is an actual bill, k is a sample number when a most recent synchronization occurs, i is an index number, $U_i$ is the estimated usage for a sample corresponding to index i and $R_i$ is the estimated cost per resource unit for a sample corresponding to index i.

* * * * *